US009071011B2

(12) United States Patent
Matsumoto et al.

(10) Patent No.: US 9,071,011 B2
(45) Date of Patent: Jun. 30, 2015

(54) ELECTRICAL CONNECTOR AND SQUIB CONNECTION DEVICE

(71) Applicant: J.S.T. Mfg. Co., Ltd., Osaka (JP)

(72) Inventors: Hiroyuki Matsumoto, Yokohama (JP); Munetaka Yasuda, Yokohama (JP)

(73) Assignee: J.S.T. MFG. CO., LTD., Osaka-shi (JP)

( * ) Notice: Subject to any disclaimer, the term of this patent is extended or adjusted under 35 U.S.C. 154(b) by 40 days.

(21) Appl. No.: 14/053,838

(22) Filed: Oct. 15, 2013

(65) Prior Publication Data

US 2014/0106601 A1 Apr. 17, 2014

(30) Foreign Application Priority Data

Oct. 17, 2012 (JP) ..... 2012-230366

(51) Int. Cl.

| | |
|---|---|
| ***H01R 13/62*** | (2006.01) |
| ***H01R 13/627*** | (2006.01) |
| ***H01R 13/639*** | (2006.01) |
| ***H01R 13/641*** | (2006.01) |

(52) U.S. Cl.

CPC ..... *H01R 13/62* (2013.01); *H01R 13/6271* (2013.01); *H01R 13/639* (2013.01); *H01R 13/641* (2013.01)

(58) Field of Classification Search

CPC .... H01R 13/62; H01R 13/639; H01R 13/641; H01R 13/6271

USPC ..... 439/352, 489

See application file for complete search history.

(56) References Cited

U.S. PATENT DOCUMENTS

| | | | | |
|---|---|---|---|---|
| 5,591,041 | A | 1/1997 | Cecil, Jr. | |
| 2007/0264863 | A1 | 11/2007 | Nakamura | |
| 2014/0045361 | A1 * | 2/2014 | Gunreben et al. | 439/345 |

FOREIGN PATENT DOCUMENTS

| | | | |
|---|---|---|---|
| JP | H08-273759 | | 10/1996 |
| JP | 2860464 | B2 | 12/1998 |
| JP | 2001-319747 | A1 | 11/2001 |
| JP | 2007-305541 | A1 | 11/2007 |

* cited by examiner

*Primary Examiner* — Abdullah Riyami
*Assistant Examiner* — Justin Kratt
(74) *Attorney, Agent, or Firm* — Kratz, Quintos & Hanson, LLP

(57) ABSTRACT

An electrical connector of the present invention includes a housing, an electrical terminal, and a moving member that has a moving member body and a detection portion. The housing is provided with a first step portion, and the detection portion is provided with a second step portion. When the moving member is at a first position, the second step portion comes into contact with the first step portion so as to prevent the moving member from moving forward. When the mating portion is completely fitted into a retainer, the detection portion becomes displaced toward the counter mating side due to being pressed by the retainer or the inflator housing, and the second step portion becomes separated from the first step portion so as to permit the moving member to move forward. Also, a squib connection device of the present invention includes this electrical connector.

11 Claims, 23 Drawing Sheets

ELECTRICAL CONNECTOR AND SQUIB CONNECTION DEVICE

BACKGROUND OF THE INVENTION

1. Field of the Invention

The present invention belongs to the technical field of electrical connectors, it relates to an electrical connector for connection with a partner device that has an inflator housing, a squib, and a retainer. It also relates to a squib connection device that includes the partner device and the electrical connector.

2. Description of the Related Art

JP-2007-305541-A discloses male and female connectors. According to which, a detection member is prevented from being pushed inside before the two housings are mated. JP-2001-319747-A discloses an electrical connection device that can be designed so as to be compact overall and according to which an operation for engaging two constituent elements and an operation for pushing in a retaining element, which is for canceling shorting performed by a shorting element in one of the constituent elements, can be performed in one series of operations. JP-2860464-B2 discloses a positioning assurance device for an electrical connector. This electrical connector has a terminal means and is constituted by a housing, a lock arm, and a lock member that can move between a first position and a second position. When the lock arm is at an unlocked position in the case where the joining of the electrical connector and a partner connection device is incomplete, movement of the lock member from the first position to the second position is restricted, and it is indicated that the electrical connector and the partner connection device have not been completely joined.

SUMMARY OF THE INVENTION

According to the techniques disclosed in the aforementioned publications, it is possible to detect the fact that a connector has not been completely mated to a partner member, that is to say, to detect incomplete mating. Meanwhile, in the case of the connector disclosed in aforementioned JP-2007-305541-A, the detection member is pushed inward in the same direction as the mating direction of the connector. With the electrical connection device disclosed in aforementioned JP-2001-319747-A as well, the retaining element is pushed inward in the same direction as the mating direction of the first electrical connector element. For this reason, it is possible to select either: a method of pushing the detection member or the retaining element in the mating direction, mating the connector or the first electrical connector element to a partner member, and then continuing to push the detection member or the retaining element in the mating direction to cause the detection member or the retaining element to function, first pushing the connector or the first electrical connector element in the mating direction so as to connect it to a partner member, and then pushing the detection member or the retaining element in the mating direction to cause it to function. Accordingly, in the case of employing the latter method for example, there is the risk of an operational error, such as forgetting to perform the latter task of pushing the detection member or the retaining element, and there is demand for this to be addressed by instructing strict observance of the operational procedure. Also, since the detection member or the retaining element protrudes toward the counter mating side more than the connector or the first electrical connector element, there is the risk of a problem such as damage to the detection member or the retaining element due to interference with the harness or the like, and there has been demand for this to be addressed by instructing strict peripheral arrangement. In contrast, in the case of the positioning assurance device for an electrical connector disclosed in JP-2860464-B2, the mating operation is clearly intended to be performed in two steps since the movement direction of the lock member is orthogonal to the mating direction of the electrical connector, thus making it unlikely to forget to push in the lock member, and making it unlikely for the lock member to protrude toward the counter mating side of the electrical connector. Therefore, it is unlikely for a problem such as damage to the lock member to occur.

However, in the case of the positioning assurance device for an electrical connector disclosed in aforementioned JP-2860464-B2, the electrical connector can move in the movement direction before being mated to the partner connection device, and therefore if the lock member moves forward to a position inward of the lock arm for some reason, the electrical connector cannot be mated to the partner connection device even if an attempt is made, and it is necessary to move the lock member rearward and then perform the mating operation once again, which causes a commensurate reduction in operability. Also, if the lock member moves forward to a position inward of the lock arm, and an attempt is made to forcibly mate the lock member to the partner connection device, there is the risk of damage to the lock member, the partner connection device, or the like.

An object of the present invention is to provide an electrical connector and a squib connection device that can solve the above-described problems.

An electrical connector according to the present invention is an electrical connector including:

a housing that has a housing body and a mating portion, the mating portion being provided on a mating side of the housing body and capable of being mated to a retainer attached to a socket that is recessed toward a counter mating side from a surface of an inflator housing on the mating side;

an electrical terminal that is provided in the housing and has a contact portion that can come into contact with a squib terminal that rises up toward the mating side from a bottom portion of the socket; and a moving member that has a moving member body and a detection portion, the moving member body being arranged on the counter mating side of the housing body and capable of moving over the housing body along a movement direction that is at an angle to a mating direction, and the detection portion being provided on the moving member body via an elastic portion and capable of being displaced along the mating direction, wherein the housing is provided with a first step portion that extends toward the mating side from a first end face on the counter mating side while moving rearward in the movement direction, wherein the detection portion is provided with a second step portion that extends toward the counter mating side from a second end face on the mating side while moving forward in the movement direction, and wherein when the moving member is at a first position relative to the housing body, the second step portion comes into contact with the first step portion so as to prevent the moving member from moving forward in the movement direction, and when the mating portion is completely fitted into the retainer, the detection portion becomes displaced toward the counter mating side due to being pressed by the retainer or the inflator housing, and the second step portion becomes separated from the first step portion so as to permit the moving member to move forward in the movement direction, and thus the moving member can move forward from the first position relative to the housing body to a second position that is in front of the first position in terms of the movement direction.

When the mating portion of the housing is mated to the retainer, and the contact portion of the electrical terminal is brought into contact with the squib terminal, the electrical connector is mechanically and electrically connected to the partner device that has the inflator housing, the squib, and the retainer. In this case, if the mating portion is not completely fitted into the retainer, the detection portion is not pressed by the retainer or the inflator housing, and therefore the moving member is at the first position relative to the housing body, and the second step portion comes into contact with the first step portion, thus preventing the moving member from moving forward in the movement direction. Accordingly, when the moving member is at the first position relative to the housing body, it is possible to detect that the mating portion is not completely fitted into the retainer. On the other hand, when the mating portion is completely fitted into the retainer, the detection portion is pressed by the retainer or the inflator housing and becomes displaced toward the counter mating side. The second step portion moves away from the first step portion so as to permit the moving member to move forward in the movement direction. This enables the moving member to move forward from the first position relative to the housing body to the second position that is in front of the first position in terms of the movement direction. Accordingly, when the moving member has moved forward to the second position relative to the housing body, it is detected that the mating portion is completely mated to the retainer, thus realizing the prevention of incomplete mating.

In this case, the moving member body can move over the housing body along the movement direction, which is at an angle to the mating direction, thus making the mating operation clearly intended to be performed in two steps so as to make it unlikely to forget the operation for moving the moving member, and making it unlikely for the moving member to protrude toward the counter mating side of the electrical connector. This prevents a problem such as damage to the moving member from occurring. Since the moving member cannot move forward in the movement direction if the mating portion is not completely fitted into the retainer, it is possible to, for example, prevent the mating task from needing to be performed again, and prevent damage to the moving member, the retainer, and the like.

A squib connection device according to the present invention is a squib connection device including:

a partner device that has an inflator housing provided with a socket that is recessed toward a counter mating side from a surface on a mating side, a squib provided on the counter mating side of the inflator housing such that a squib terminal rises up toward the mating side from a bottom portion of the socket, and a retainer that is attached to the socket, and an electrical connector that can be mated to the partner device, wherein the electrical connector includes:

a housing that has a housing body and a mating portion, the mating portion being provided on the mating side of the housing body and capable of being mated to the retainer, an electrical terminal that is provided in the housing and has a contact portion that can come into contact with the squib terminal, and a moving member that has a moving member body and a detection portion, the moving member body being arranged on the counter mating side of the housing body and capable of moving over the housing body along a movement direction that is at an angle to a mating direction, and the detection portion being provided on the moving member body via an elastic portion and capable of being displaced along the mating direction, wherein the housing is provided with a first step portion that extends toward the mating side from a first end face on the counter mating side while moving rearward in the movement direction, wherein the detection portion is provided with a second step portion that extends toward the counter mating side from a second end face on the mating side while moving forward in the movement direction, and wherein when the moving member is at a first position relative to the housing body, the second step portion comes into contact with the first step portion so as to prevent the moving member from moving forward in the movement direction, and when the mating portion is completely fitted into the retainer, the detection portion becomes displaced toward the counter mating side due to being pressed by the retainer or the inflator housing, and the second step portion becomes separated from the first step portion so as to permit the moving member to move forward in the movement direction, and thus the moving member can move forward from the first position relative to the housing body to a second position that is in front of the first position in terms of the movement direction.

When the mating portion of the housing is mated to the retainer, and the contact portion of the electrical terminal is brought into contact with the squib terminal, the electrical connector is mechanically and electrically connected to the partner device. In this case, if the mating portion is not completely fitted into the retainer, the detection portion is not pressed by the retainer or the inflator housing, and therefore the moving member is at the first position relative to the housing body, and the second step portion comes into contact with the first step portion, thus preventing the moving member from moving forward in the movement direction. Accordingly, when the moving member is at the first position relative to the housing body, it is possible to detect that the mating portion is not completely fitted into the retainer. On the other hand, when the mating portion is completely fitted into the retainer, the detection portion is pressed by the retainer or the inflator housing and becomes displaced toward the counter mating side, and the second step portion moves away from the first step portion so as to permit the moving member to move forward in the movement direction, and this enables the moving member to move forward from the first position relative to the housing body to the second position that is in front of the first position in terms of the movement direction. Accordingly, when the moving member has moved forward to the second position relative to the housing body, it is detected that the mating portion is completely mated to the retainer, thus realizing the prevention of incomplete mating.

In this case, the moving member body can move over the housing body along the movement direction, which is at an angle to the mating direction, thus making the mating operation clearly intended to be performed in two steps so as to make it unlikely to forget the operation for moving the moving member, and making it unlikely for the moving member to protrude toward the counter mating side of the electrical connector, and this prevents a problem such as damage to the moving member from occurring. Since the moving member cannot move forward in the movement direction if the mating portion is not completely fitted into the retainer, it is possible to, for example, prevent the mating task from needing to be performed again, and prevent damage to the moving member, the retainer, and the like.

DETAILED DESCRIPTION OF THE INVENTION

Figure 1:
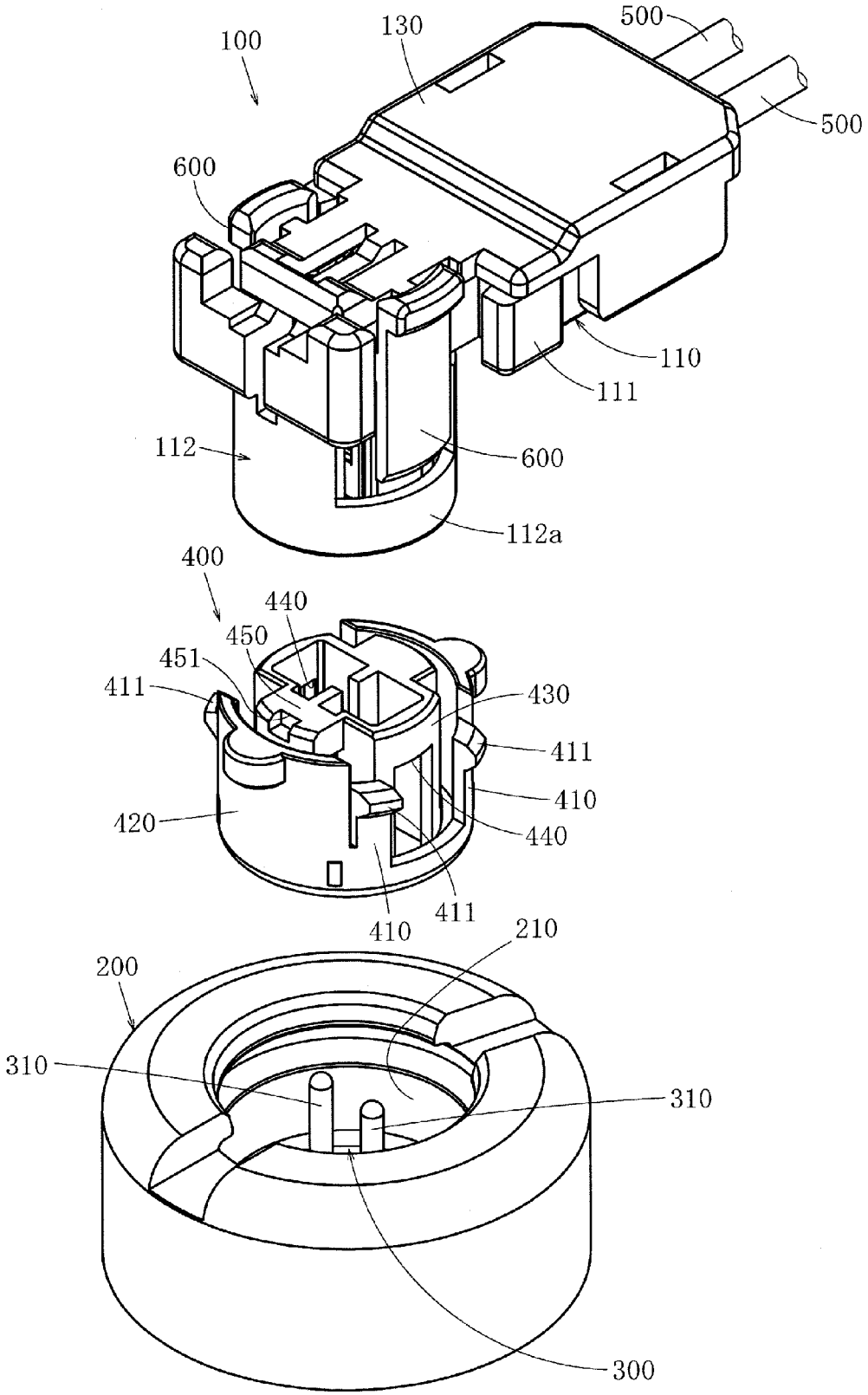
FIG. 1 is an exploded perspective view of an electrical connector that is an embodiment of an electrical connector of the present invention, along with embodiments of an inflator housing, a squib, and a retainer.
Figure 2:
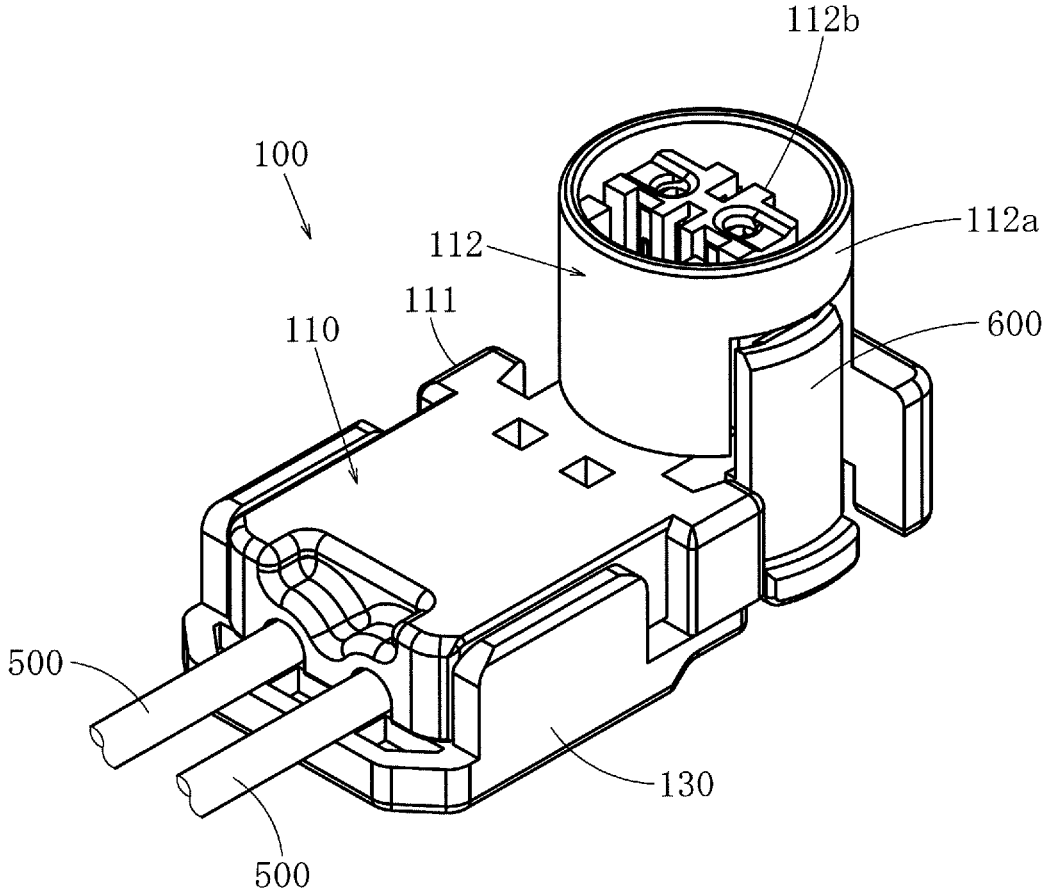
FIG. 2 is a perspective view of the electrical connector as viewed from another angle.
Figure 10:
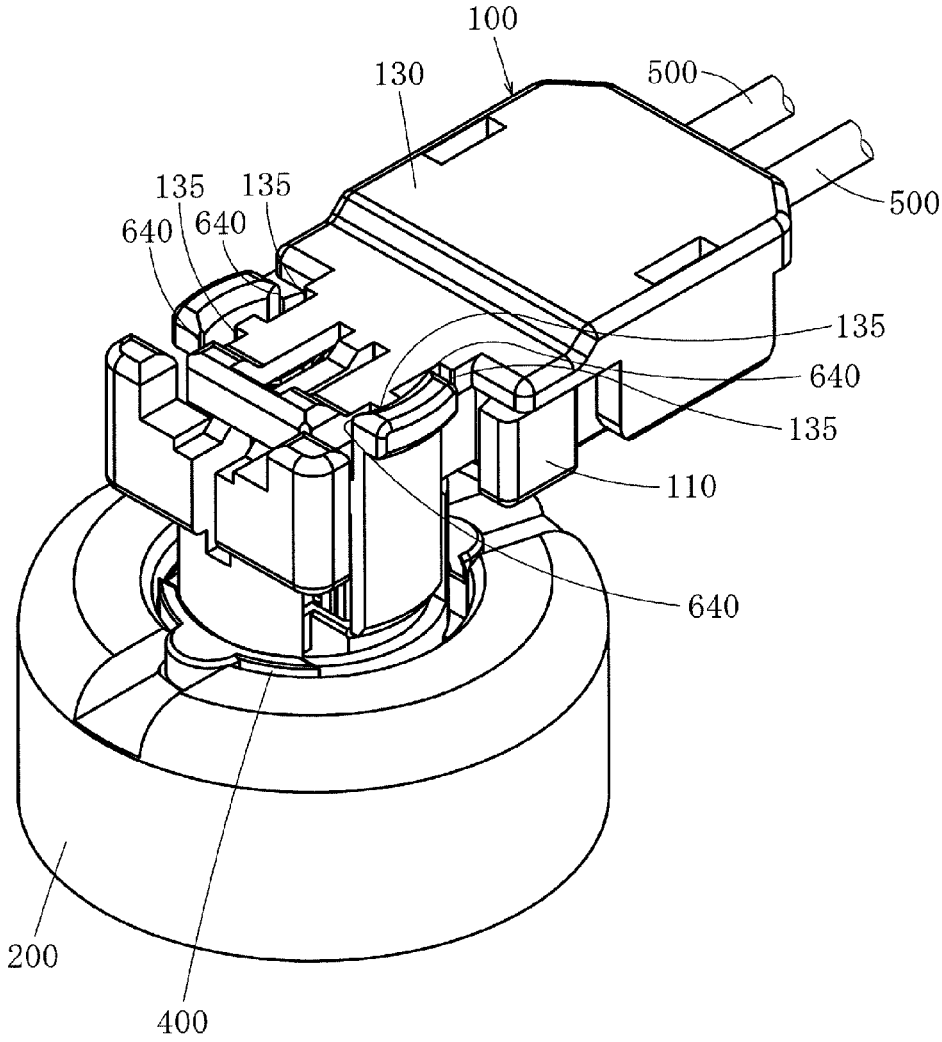
FIG. 10 is a perspective view of the electrical connector, the inflator housing, the squib, and the retainer when a mating portion of the housing starts being mated to the retainer. The moving member is at the first position relative to the housing body.
Figure 11:
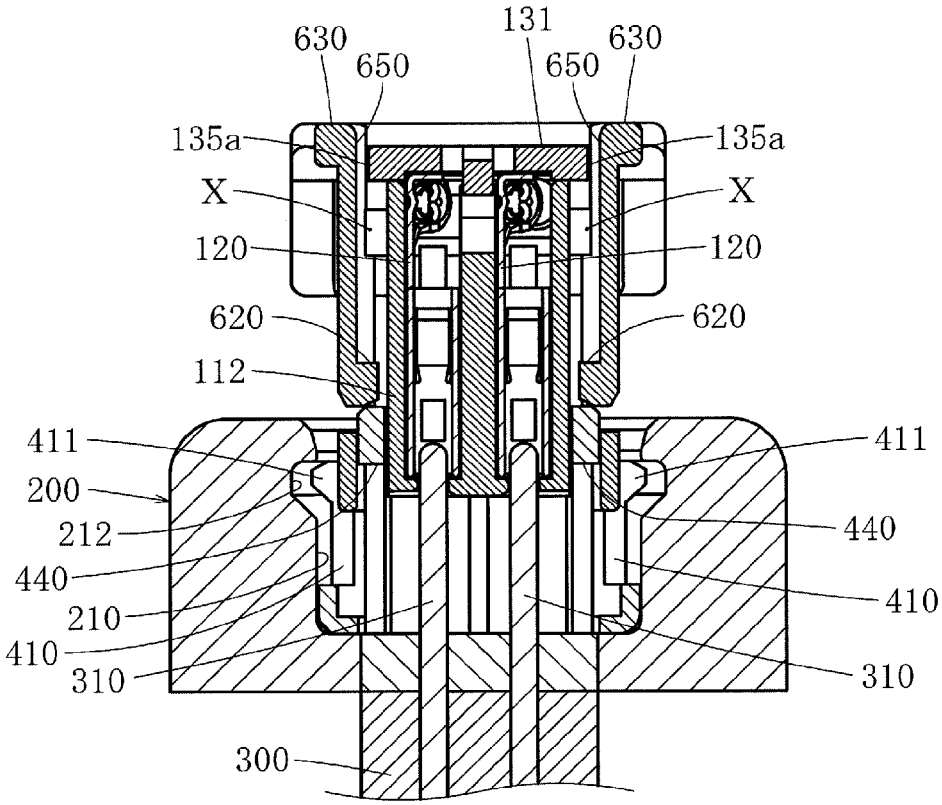
FIG. 11 is a vertical cross-sectional view of the electrical connector, the inflator housing, the squib, and the retainer in the state shown in FIG. 10, the cross-section being taken along a line that passes through lock arms.

Embodiments of the present invention will be described below. FIGS. 1 to 23 show an embodiment of an electrical connector and a squib connection device according to the present invention. The electrical connector and the squib connection device are elements constituting an inflator, which is a device for inflating an airbag. As shown in FIG. 1, the squib connection device includes a partner device and an electrical connector 100 for mating with the partner device, and the partner device has an inflator housing 200, a squib 300, and a retainer 400. In both the electrical connector 100 and the partner device that are to be mated to each other, the mating side refers to the side on which the one is to be mated to the other, and the mating direction refers to the direction in which the one faces the other when the electrical connector 100 and the partner device are arranged such that their mating sides oppose each other. The counter mating side is the side opposite to the mating side, and the counter mating direction is the direction opposite to the mating direction. Hereinafter, when the mating side, the mating direction, the counter mating side, or the counter mating direction relative to a member or portion is simply referred to, if that member or portion is provided in the electrical connector 100, that side or direction refers to the mating side, the mating direction, the counter mating side, or the counter mating direction of the electrical connector 100, and if that member or portion is provided in the partner device, that side or direction refers to the mating side, the mating direction, the counter mating side, or the counter mating direction of the partner device. Accordingly, when FIG. 11 is oriented such that the reference signs can be read properly, the mating side of the electrical connector 100 refers to the lower side of the electrical connector 100 in the figure, the mating direction refers to the downward direction of the electrical connector 100 in the figure, the counter mating side refers to the upper side of the electrical connector 100 in the figure, and the counter mating direction refers to the upward direction of the electrical connector 100 in the figure. Also, in the same figure, the mating side of the partner device refers to the upper side of the partner device in the figure, the mating direction refers the upward direction of the partner device in the figure, the counter mating side refers to the lower side of the partner device in the figure, and the counter mating direction refers to the downward direction of the partner device in the figure.

Figure 9:
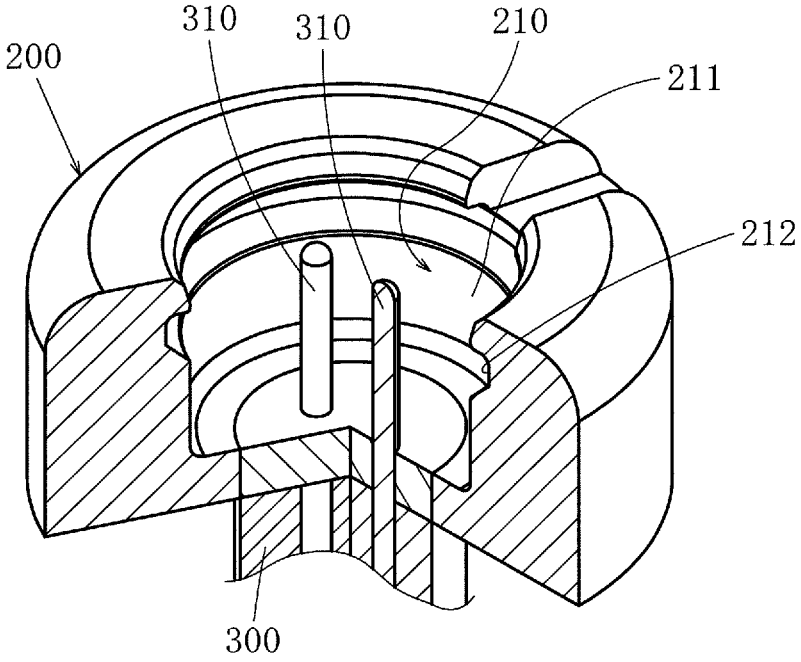
FIG. 9 is a perspective view of the inflator housing and the squib, with portions thereof shown in cross-section.

The inflator housing 200 shown in FIGS. 1, 9, and 11 is formed from an aluminum alloy, and it may be formed from a conductive material in this way, or may be formed from an insulating material or another material. The inflator housing 200 is provided with a socket 210 that is recessed toward the counter mating side from the surface on the mating side. The socket 210 is formed such that the interior space is shaped as a circular column, but it may be formed such that the interior space is shaped as a prism or has another shape.

As shown in FIGS. 1, 9, and 11, a pair of squib terminals 310 that rise up toward the mating side are provided on the mating side of the squib 300. These squib terminals 310 are formed from a conductive material and are bar-shaped. They may also be tube-shaped, plate-shaped, or have another shape. The squib terminals 310 are also sometimes called "pins". When current is applied to the squib 300 via the pair of squib terminals 310, the squib 300 receives the electrical energy and generates heat. Since the inflator housing 200 is formed from a conductive material, an insulating member is provided so as to surround the squib terminals 310, thus insulating the squib terminals 310 and the inflator housing 200 from each other. Depending on how grounding is performed, for example, the squib terminals can be monopolar or have three or more poles. The squib 300 is provided on the counter mating side of the inflator housing 200 such that the squib terminals 310 rise up toward the mating side from the bottom portion of the socket 210. An igniting agent and a gas-forming agent are arranged so as to surround the squib 300. A compressed airbag is accommodated in the counter mating side of the inflator housing 200. Accordingly, when the squib 300 receives electrical energy and generates heat, the igniting agent ignites, the gas-forming agent thus forms gas, and that gas deploys the airbag.

The retainer 400 shown in FIG. 1 is formed from a synthetic resin, and it may be formed from an insulating material in this way, or it may be formed from a conductive material, or another material in the case of employing a configuration in which it is insulated from the squib terminals 310 or later-described electrical terminals 120. The retainer 400 is formed such that its external shape corresponds to the interior space of the socket 210, and therefore in the case of this embodiment, the outer periphery of a horizontal cross-section of the retainer 400 is substantially circular. However, the outer periphery of the horizontal cross-section of the retainer may be polygonal or have another shape as long as it can fit in the interior space of the socket 210. The retainer 400 is provided with a cavity that penetrates in the mating direction and allows the introduction of the squib terminals 310 from the counter mating side. The retainer 400 is attached to the socket 210. In order to ensure force for engaging the retainer 400 and the socket 210, the retainer 400 is provided with attachment arms 410. Projections 411, provided on the attachment arms 410, fit into a groove 212 provided in the socket 210. Each attachment arm 410 extends in the mating direction in the periphery of the retainer 400, one end being fixed to the retainer 400, and the other end being provided with a projection 411 that projects outward. When viewing the attachment arm 410 in the mating direction, the outer side of the attachment arm 410 is the side that is away from the central portion of the retainer 400, and the inner side is the side opposite to the outer side. The groove 212 is provided so as to be recessed outward in a structural wall 211, which is a wall that constitutes the socket 210 of the inflator housing 200. When viewing the socket 210 in the mating direction, the outer side of the socket 210 is the side that is away from the central portion of the socket 210, and the inner side is the side opposite to the outer side. When the retainer 400 is pushed into the socket 210, the attachment arms 410 elastically deform inward, due to being pushed by the structural wall 211, thus allowing the retainer 400 to be inserted into the socket 210. When the projections 411 reach the position of the groove 212, the attachment arms 410 return to their original state, and the projections 411 fit into the groove 212, and the retainer 400 and the socket 210 are thus engaged with each other.

As shown in FIGS. 1 to 8, the electrical connector includes a housing 110, the electrical terminals 120 provided in the housing 110, and a moving member 130 provided in the housing 110. The housing 110 is formed from a synthetic resin, and it may be formed from an insulating material in this way, or it may be formed from a conductive material, or it may be formed from another material in the case of employing a configuration in which it is insulated from the electrical terminals 120 or the squib terminals 310. The housing 110 includes a housing body 111 and a mating portion 112 that is provided on the mating side of the housing body 111 and is for mating with the retainer 400. The housing body 111 extends in a direction orthogonal to the mating direction, and the mating portion 112 extends in the mating direction from one end side of the housing body 111. However, the shapes of the housing body and the mating portion are not intended to be limited to this. The housing body may, for example, be shaped as a cuboid or the like that does not have a lengthwise direction, or may be formed such that the lengthwise direction of the housing body forms an angle greater than 0 degrees and less than 180 degrees relative to the mating direction. Also, the mating portion need only be provided on the mating side of the housing body and may be provided at any position on the face of the housing body that faces the mating direction. The mating portion 112 and the retainer 400 are mated to each other by a protruding portion provided on one of them being inserted into a recessed portion provided on the other one and are detached from each other by pulling the protruding portion out of the recessed portion. As one variation, it is possible for the mating portion and the retainer to be fixedly mated to each other so as to be permanently mated. In the case of this embodiment, the mating portion 112 is provided with a first tube-shaped portion 112*a* as a protruding portion, the retainer 400 is correspondingly provided with a second tube-shaped portion 420 as a recessed portion, and the two are mated to each other by the first tube-shaped portion 112*a* being placed inside the second tube-shaped portion 420. Conversely, the mating may be performed by the second tube-shaped portion being placed inside the first tube-shaped portion. Although the first tube-shaped portion 112*a* and the second tube-shaped portion 420 are both shaped as circular tubes, they may be shaped as polygonal tubes, or elliptical tubes, or have another type of tube shape. In the case of this embodiment, the mating portion 112 is further provided with a third tube-shaped portion 112*b* as a protruding portion, the retainer 400 is correspondingly further provided with a fourth tube-shaped portion 430 as a recessed portion, and the two are mated to each other by the third tube-shaped portion 112*b* being placed inside the fourth tube-shaped portion 430. Also, the electrical terminals 120 are arranged inside the third tube-shaped portion 112*b*, the interior of the fourth tube-shaped portion 430 serves as the above-described cavity, and the squib terminals 310 are arranged therein. However, in the case where, for example, the mating portion 112 and the retainer 400 are stably mated to each other by merely the mating of the first tube-shaped portion 112*a* and the second tube-shaped portion 420 to each other, the third tube-shaped portion 112*b* and the fourth tube-shaped portion 430 do not need to be provided.

Figure 3:
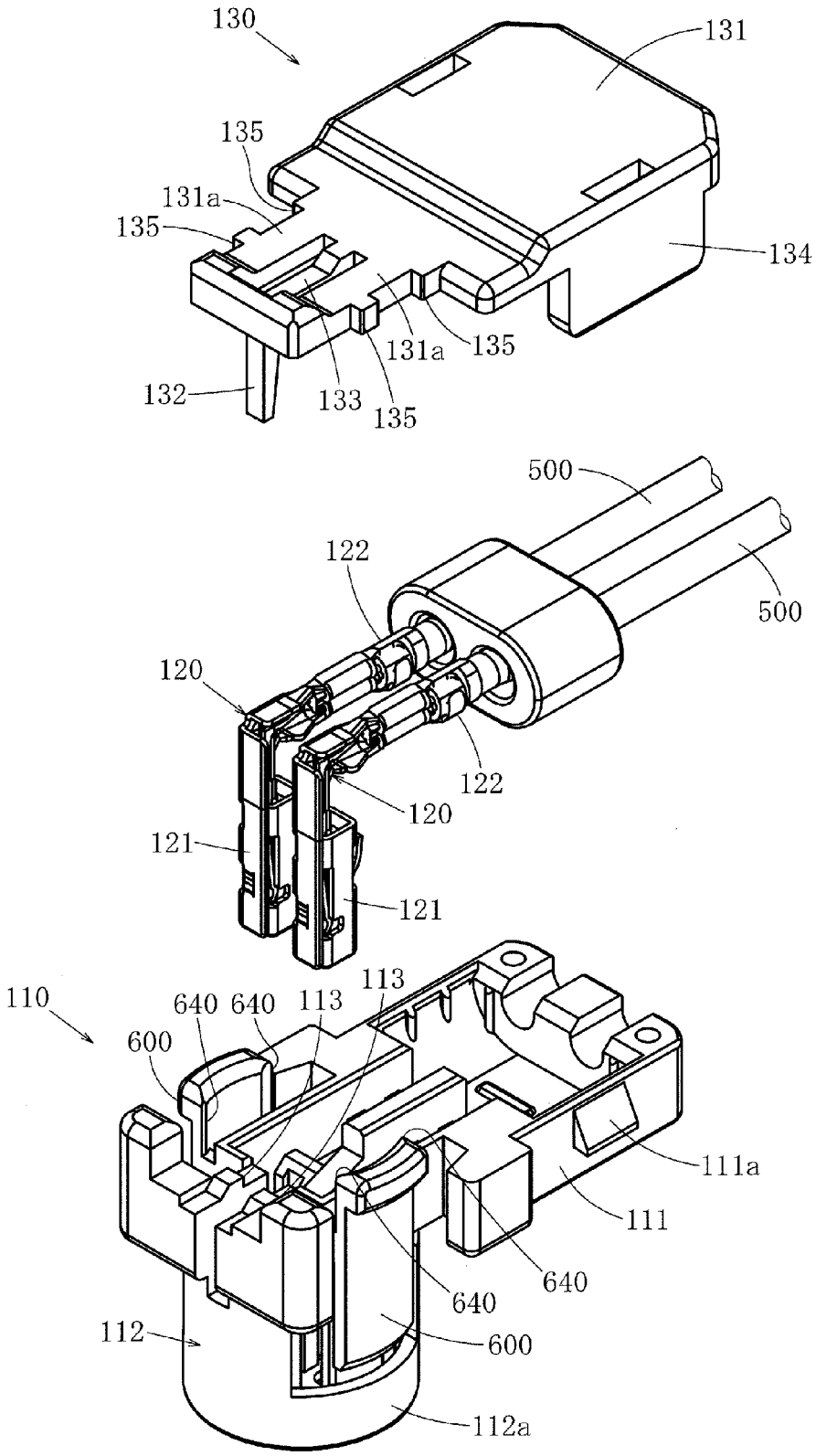
FIG. 3 is an exploded perspective view of the electrical connector.
Figure 4:
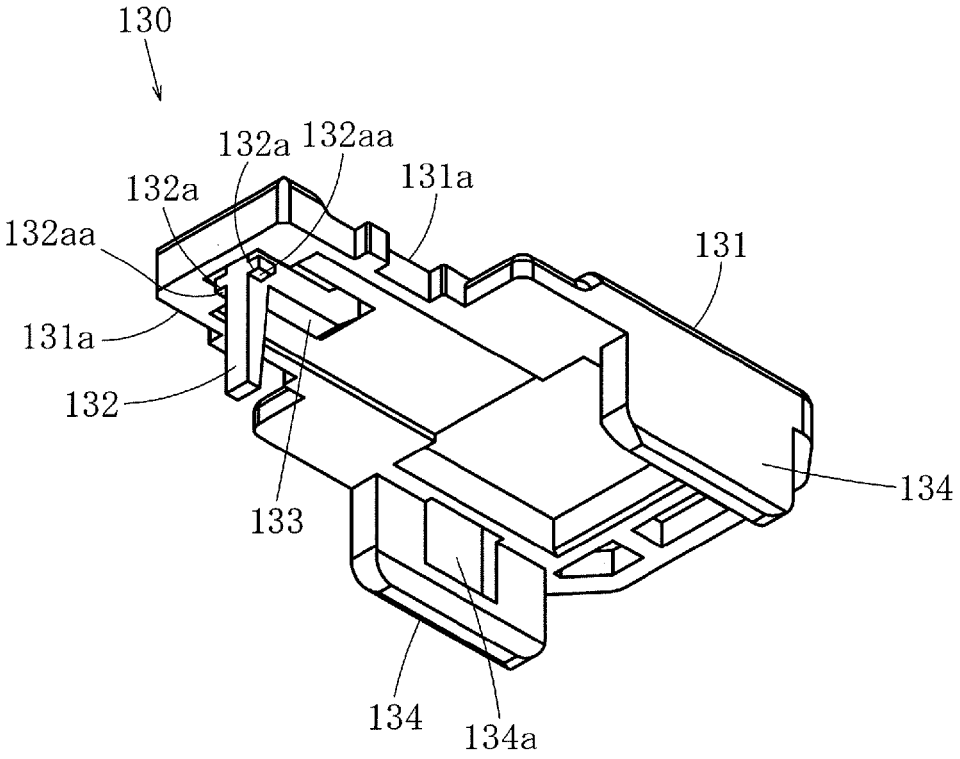
FIG. 4 is a perspective view of a moving member as viewed from another angle.
Figure 5:
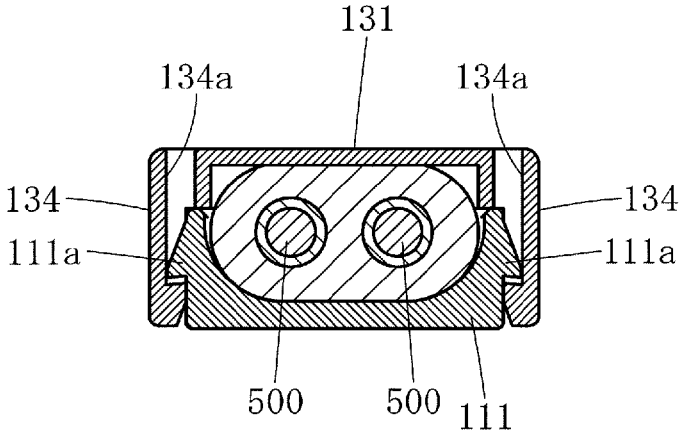
FIG. 5 is a vertical cross-sectional view of the housing and the moving member.
Figure 24:
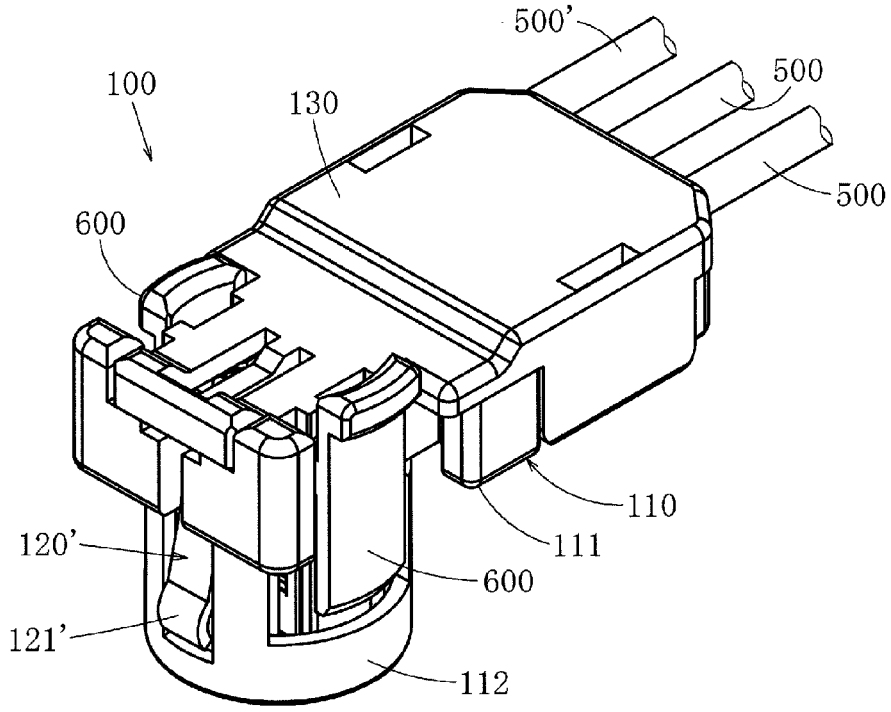
FIG. 24 is a perspective view of an electrical connector according to a variation of the electrical connector of the present invention.

As shown in FIGS. 3 and 11, the number of electrical terminals 120 that are provided corresponds to the number of squib terminals 310. Accordingly, in the case of this embodiment, a pair of electrical terminals 120 is provided. The electrical terminals 120 are formed from a conductive material, each include a contact portion 121 and a connection portion 122 and are provided in the housing 110. The contact portions 121 are provided on the mating side of the electrical terminals 120, but they may be provided on, for example, the counter mating side of the electrical terminals or on another portion. The contact portions 121 are provided in the mating portion 112, and the contact portions 121 are configured so as to come into contact with the squib terminals 310 when the mating portion 112 is mated to the retainer 400. Since the squib terminals 310 are formed in the shape of bars, the contact portions 121 of the electrical terminal 120 are formed in the shape of tubes so as to fit around the squib terminals 310. If the squib terminals are formed in the shape of tubes, on the other hand, the contact portions of the electrical terminals may be formed in the shape of bars so as to fit into the squib terminals. The contact portions of the electrical terminals need only be formed in a shape that allows coming into contact with the squib terminals and may be formed in the shape of plates, for example, or have another shape. The connection portions 122 each include a connection structure for connection to a conducting body 500. In the case of this embodiment, the conducting body 500 is an electrical wire that includes a core wire and an insulating coating that coats the core wire, and therefore the connection structure is constituted by barrels, namely a wire barrel and an insulation barrel. The wire barrel is a crimping part that rises from the plate width direction of the electrical terminal 120 and crimps the portion of the core wire that is exposed from the end of the conducting body 500. The insulation barrel is a crimping part that rises from the plate width direction of the electrical terminal 120 on the side far from the contact portion 121 relative to the wire barrel of the electrical terminal 120 and crimps the insulating coating on the end of the conducting body 500. The conducting body 500 includes not only the electrical wire, but also a shielded cable or an element thereof for example, a flat flexible cable such as an FFC (Flexible Flat Cable) or an element thereof, and furthermore includes a conducting means that includes another conducting body. Also, the connection structure may be, for example, a structure for insulation displacement of the conducting body, a structure for piercing the conducting body, a structure for soldering the conducting body, or another structure. In the case of this embodiment, the contact portion 121 is mounted inside the mating portion 112, and the connection portion 122 is mounted inside the housing body 111, and therefore the contact portion 121 extends in the mating direction, which is the lengthwise direction of the mating portion 112, and the connection portion 122 extends in a direction orthogonal to the mating direction, which is the lengthwise direction of the housing body 111, thus making the electrical terminal 120 L-shaped. However, the electrical terminal may be, for example, I-shaped or V-shaped or have another shape, and it is sufficient that the contact portion and the connection portion are provided inside the housing. FIG. 24 shows a variation of the electrical connector 100. In the case of this electrical connector 100, another electrical terminal 120' is further provided in addition to the pair of electrical terminals 120. Other aspects of the configuration are similar to the electrical connector of this embodiment. The other electrical terminal 120' includes a contact portion 121' provided on the mating side, and a connection portion (not shown) that has a connection structure for connection with another conducting body 500'. The contact portion 121' protrudes outward from an opening provided in the mating portion 112, and when the mating portion 112 is mated to the retainer 400, the contact portion 121' comes into contact with the structural wall 211 of the socket 210 and conducts electricity to the inflator housing 200. The other conducting body 500' is an electrical wire configured similarly to the conducting body 500 and includes not only the electrical wire, but also a shielded cable or an element thereof for example, includes a flat flexible cable such as an FFC or an element thereof. Furthermore, it includes a conducting means that includes another conducting body. The connection portion of the other electrical terminal 120' is configured similarly to the connection portions 122 of the electrical terminals 120 and is connected to the other conducting body 500' in a similar manner to the connection portions 122. Furthermore, there is a variation of the electrical connector 100 in which connection with a shielded cable is performed. In this variation, for example, the signal wire of the shielded cable is connected to the connection portion 122 of the electrical terminal 120 as the conducting body 500, and the outer conducting body of the shielded cable is connected to the connection portion of the other electrical terminal 120' as the other conducting body 500'. There are also modes in which the electrical terminals do not include the connection portion. Among such modes, there is a mode of the electrical terminals in which electrical conduction with the outside is performed in a contactless manner.

As shown in FIGS. 1 to 8, the moving member 130 includes a moving member body 131 and a detection portion 132. The moving member 130 is formed from a synthetic resin, and it may be formed from an insulating material in this way, or it may be formed from a conductive material or another material in the case of employing a configuration in which it is insulated from the electrical terminals 120 or the squib terminals 310. The moving member body 131 is arranged on the counter mating side of the housing body. The moving member body 131 is flat plate-shaped and faces the mating direction, but the moving member body may, for example, be shaped as a curved plate or have another shape, and the orientation of the moving member body or the surface thereof does not need to be associated with the mating direction and may be any orientation. Also, the moving member body 131 can move over the housing body 111 along a movement direction that is at an angle to the mating direction. In the case of this embodiment, the movement direction is a direction orthogonal to the mating direction, but it may be at an angle greater than 0 degrees and less than 180 degrees to the mating direction. The detection portion 132 is provided on the moving member body 131 via an elastic portion 133 and can be displaced along the mating direction. Specifically, the elastic portion 133 extends forward in the movement direction from the front side of the moving member body 131 in terms of the movement direction, and the detection portion 132 extends in the mating direction from an end portion of the elastic portion 133 on the front side in terms of the movement direction. However, the elastic portion may be provided on the moving member body on the rear side in terms of the movement direction, on the mating side, on either side in the width direction, or on another portion. Here, the width direction refers to the direction that is orthogonal to both the mating direction and the movement direction. Two or more detection portions and two or more elastic portions may be provided. "Forward" and "on the front side" in the movement direction refer to the direction and side indicated by the arrow F in FIG. 7, and "rearward" and "on the rear side" in the movement direction refer to the direction and side indicated by the arrow R in FIG. 7. The detection portion 132 and the elastic portion 133 are formed from the same material as the moving member body 131 and formed integrally therewith, but they may be provided separately from the moving member body and connected to the moving member body. Also, the detection portion 132 and the elastic portion 133 are formed from the same material as each other and formed integrally with each other, but the detection portion and the elastic portion may be provided separately and then linked by, for example, being connected to each other, arranged adjacently to each other, joined together, or using another method. The elastic portion 133 is shaped as a bar and undergoes elastic deformation by flexing in the manner of a cantilevered beam, but the elastic portion may be configured by a flat spring, a helical spring, or another elastic member. Side plates 134 that face the width direction and extend in the mating direction are provided on respective sides of the moving member body 131 in terms of the width direction, and the inner side of each of the side plates 134 in terms of the width direction is provided with a groove 134*a* that is recessed toward the outer side of side plate 134 in terms of the width direction and extends along the movement direction. The outer side of the side plate 134 in terms of the width direction refers to the side of the side plate 134 that is away from the central portion of the moving member body 131 along the width direction, and the inner side in terms of the width direction refers to the opposite side. Also, a protruding portion 111*a* that protrudes toward the outer side in terms of the width direction is provided on the two walls of the housing body 111 on the width-direction sides. When the protruding portions 111*a* of the housing body 111 are fitted into the grooves 134*a* of the side plates 134 using the flexibility of the moving member body 131, the moving member body 131 can move over the housing body 111 along the movement direction due to the protruding portions 111*a* moving along the movement direction inside the grooves 134*a*. The outer side of the housing body 111 in terms of the width direction refers to the side of the housing body 111 that is away from the central portion of the housing body 111, and the inner side in terms of the width direction refers to the opposite side. Alternatively, the moving member body may be made able to move over the housing body along the movement direction using, for example, a configuration in which the protruding portions are provided on the moving member body and the grooves are provided in the housing body, a configuration in which the mating-side end portions of the side plates are extended in the width direction so as to come into contact with the mating-side faces of the housing body, such that the housing body is hugged by the side plates or another structure.

Figure 6:
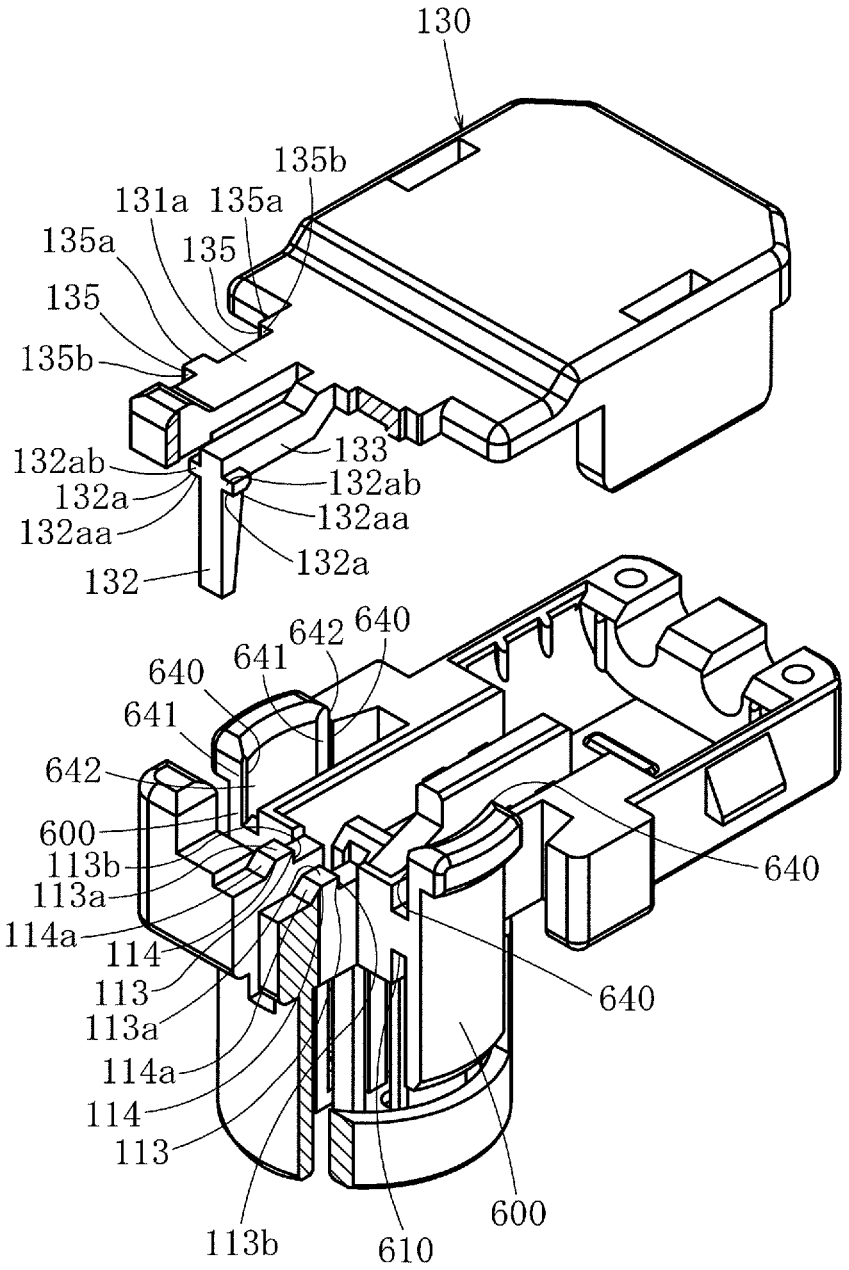
FIG. 6 is an exploded perspective view of the housing and the moving member of the electrical connector. Portions thereof are shown in cross-section.
Figure 7:
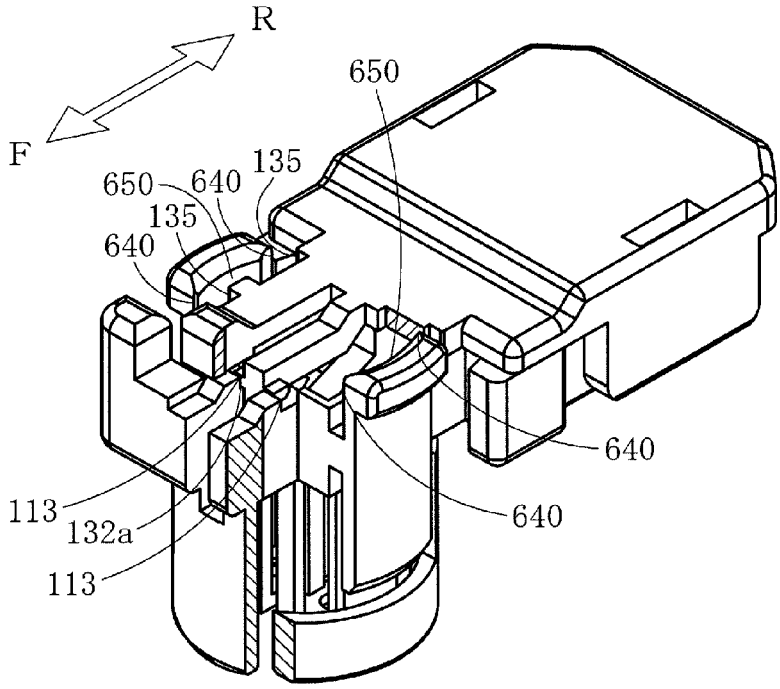
FIG. 7 is a perspective view of the housing and the moving member when the moving member is at a first position relative to the housing body. Portions thereof are shown in cross-section.

As shown in FIGS. 3, 6, 7, and the like, the housing 110 is provided with first step portions 113 that extend rearward in the movement direction and extend toward the mating side from a first end face 113*a* on the counter mating side. In the case of this embodiment, two first step portions 113 are provided aligned in the width direction at positions that are on the front side of the housing body 111 in terms of the movement direction and are in front of the mating portion 112 in terms of the movement direction. The first end faces 113*a* of the housing body 111 are both formed so as to face the counter mating side. The housing body 111 is provided with a level change that extends toward the mating side rearward of each of the first end faces 113*a* in terms of the movement direction, and a rear face 113*b* that faces rearward in the movement direction and extends toward the mating side is connected to the rear end edge of each of the first end faces 113*a* in terms of the movement direction. The first step portions 113 are formed by the level changes extending from the first end faces 113*a* toward the mating side. The first step portions 113 are each shaped as an upside down L when viewed in the width direction, or the same shape reversed in the left-right direction. The rear faces may face rearward in the movement direction with a tilt. The first step portions may be provided on the mating portion. The first step portions may be provided on any portion along the movement direction, or the width direction on the housing body, or the mating portion. One first step portion may be provided, or three may be provided, or more may be provided.

As shown in FIGS. 3, 6, 7, and the like, the detection portion 132 is provided with second step portions 132*a* that extend forward in the movement direction and extend toward the counter mating side from second end faces 132*aa* on the mating side. In the case of this embodiment, a second step portion 132*a* is provided on each of the two width-direction sides of the detection portion 132. The second end faces 132*aa* of the detection portion 132 are formed so as to face the mating side. The detection portion 132 is provided with a level change that extends toward the counter mating side in front of each of the second end faces 132*aa* in terms of the movement direction, and a front face 132*ab* that faces forward in the movement direction and extends toward the counter mating side is connected to the front end edge of each of the second end faces 132*aa* in terms of the movement direction. The second step portions 132*a* are formed by the level changes extending from the second end faces 132*aa* toward the counter mating side. The second step portions 132*a* are each shaped as an L when viewed in the width direction, or the same shape reversed in the left-right direction. The front faces may face forward in the movement direction with a tilt. The second step portions may be provided on any portion along the movement direction or the width direction on the detection portion. One second step portion may be provided, or three may be provided or more may be provided.

Figure 8:
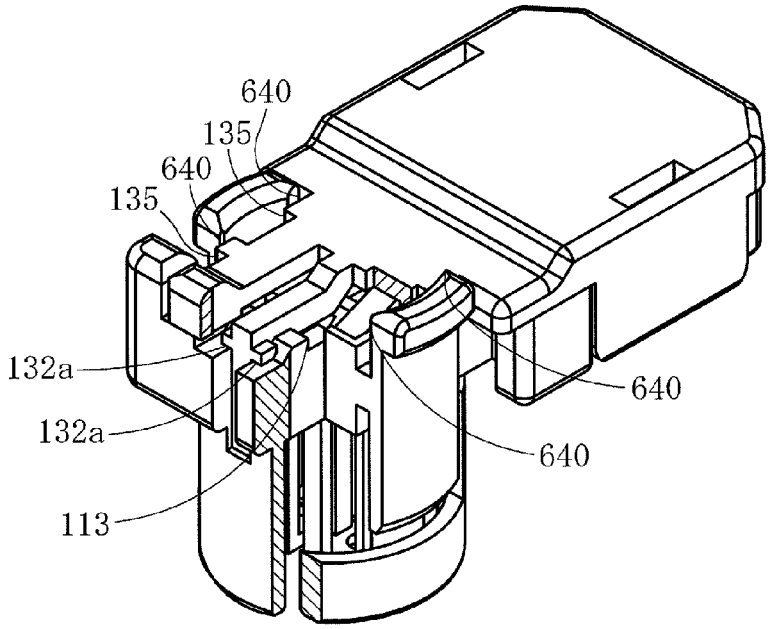
FIG. 8 is a perspective view of the housing and the moving member when the moving member is at a second position relative to the housing body. Portions thereof are shown in cross-section.
Figure 12:
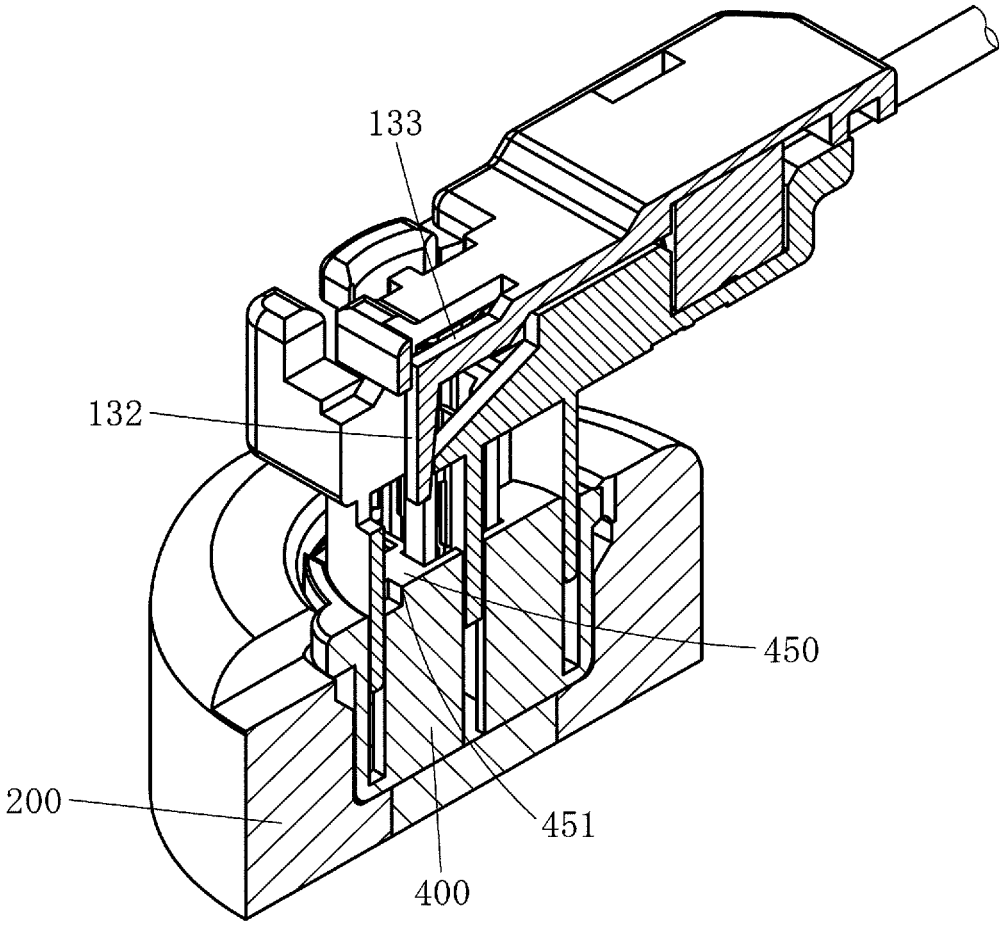
FIG. 12 is a perspective view of the electrical connector, the inflator housing, the squib, and the retainer in the state shown in FIG. 10, the cross-section being taken along a line that passes through a detection portion.
Figure 13:
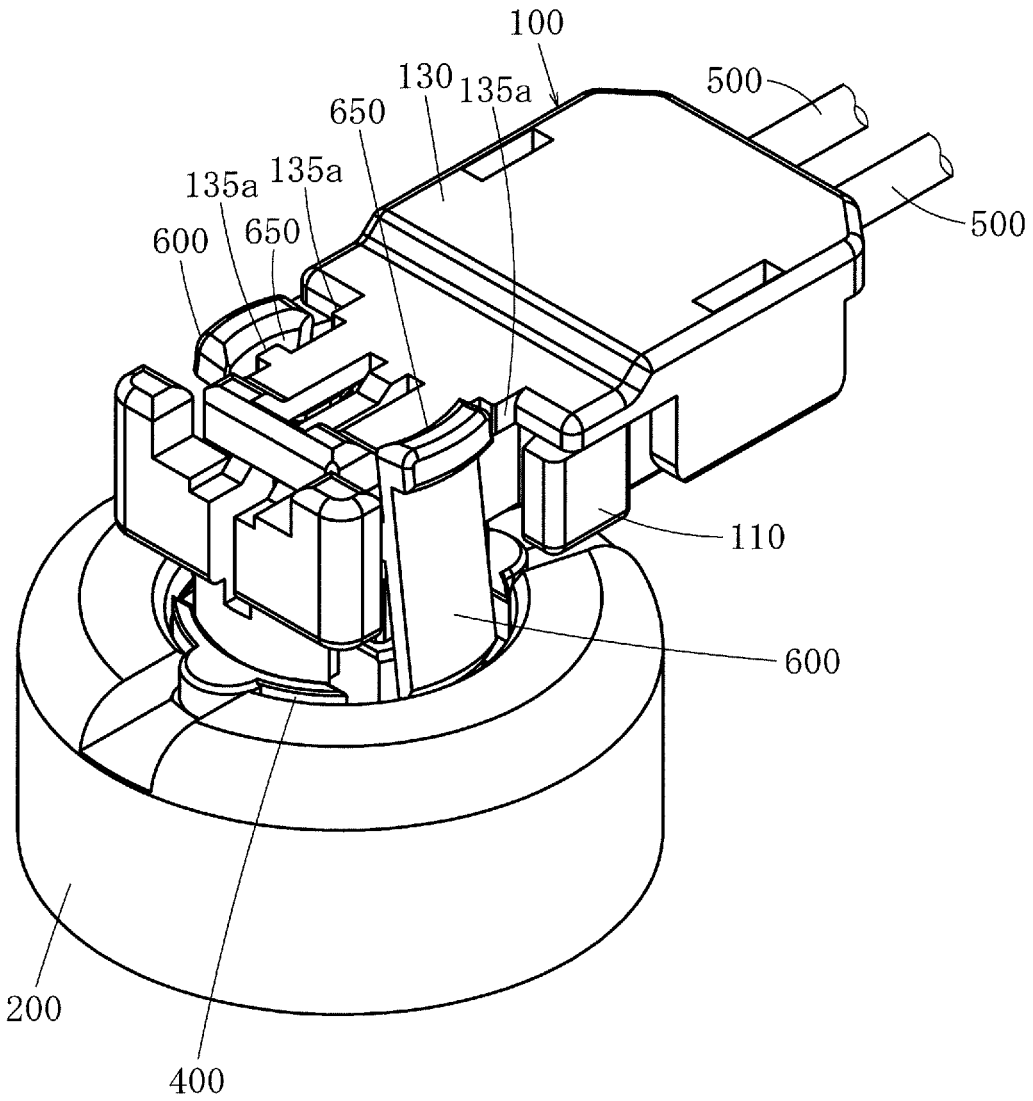
FIG. 13 is a perspective view of the electrical connector, the inflator housing, the squib, and the retainer midway during the mating of the mating portion of the housing to the retainer. The moving member is at the first position relative to the housing body.
Figure 14:
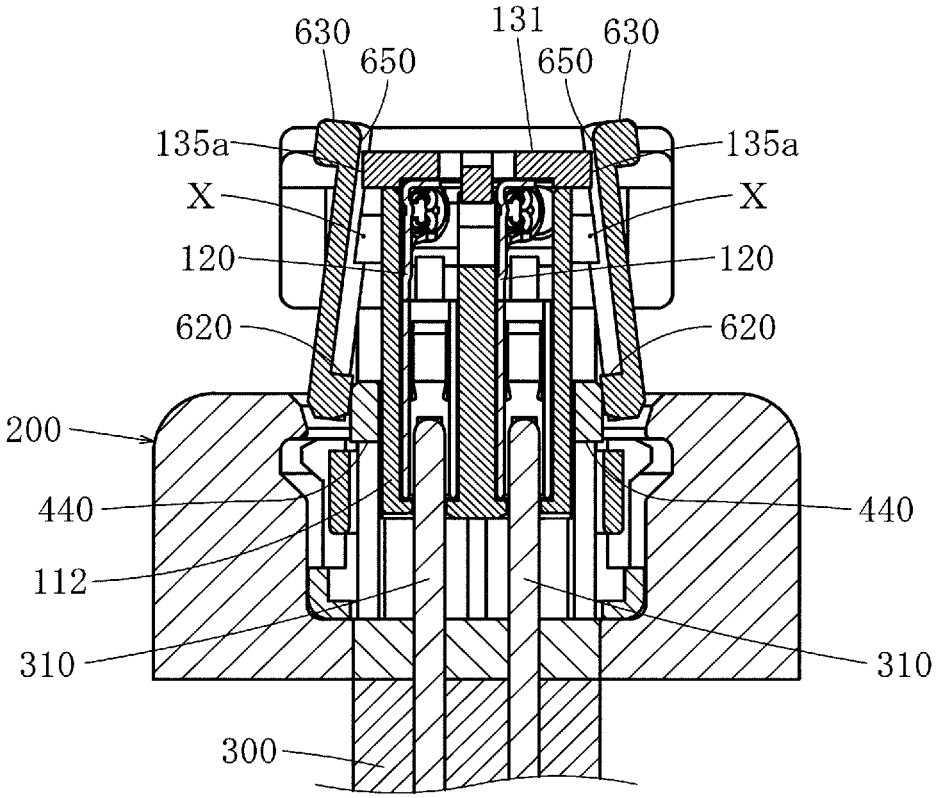
FIG. 14 is a vertical cross-sectional view of the electrical connector, the inflator housing, the squib, and the retainer in the state shown in FIG. 13, the cross-section being taken along a line that passes through the lock arms.
Figure 15:
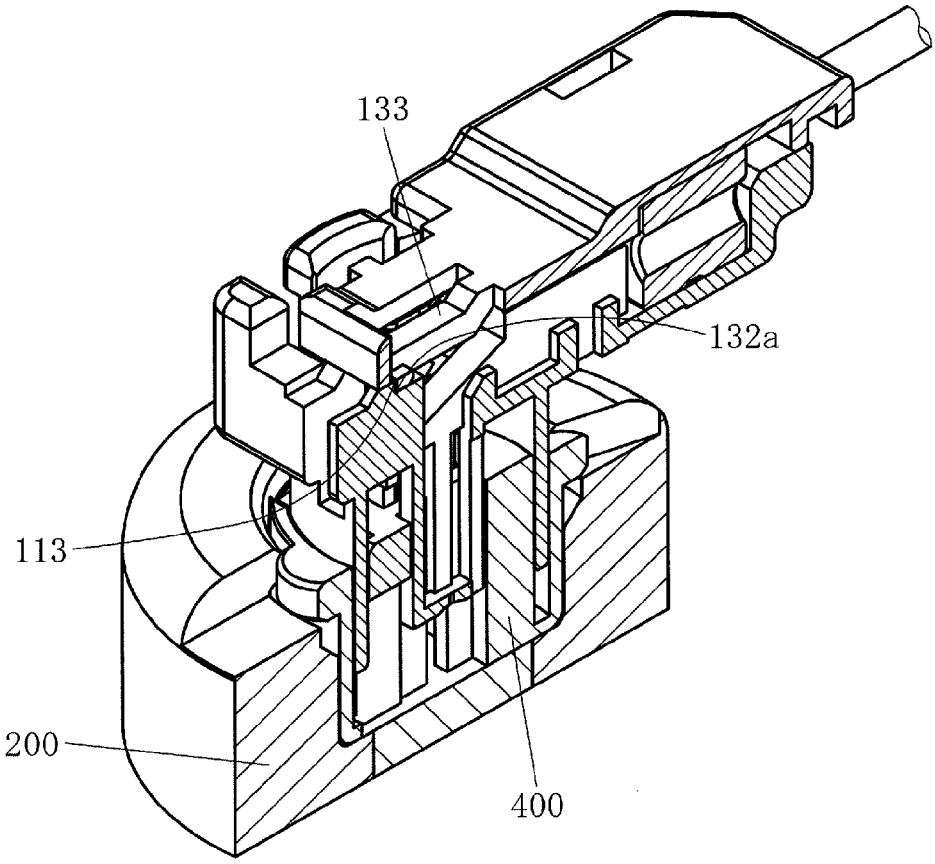
FIG. 15 is a perspective view of the electrical connector, the inflator housing, the squib, and the retainer in the state shown in FIG. 13, the cross-section being taken along a line that passes through a first step portion of the housing.
Figure 16:
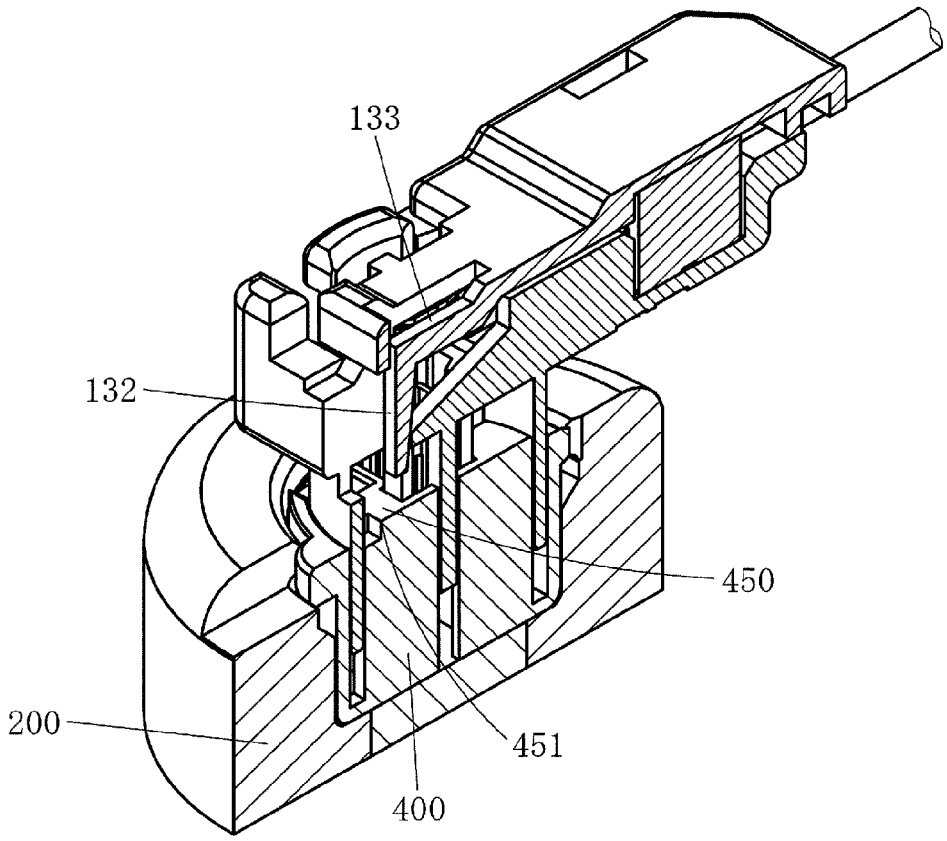
FIG. 16 is a perspective view of the electrical connector, the inflator housing, the squib, and the retainer in the state shown in FIG. 13, the cross-section being taken along a line that passes through the detection portion.
Figure 17:
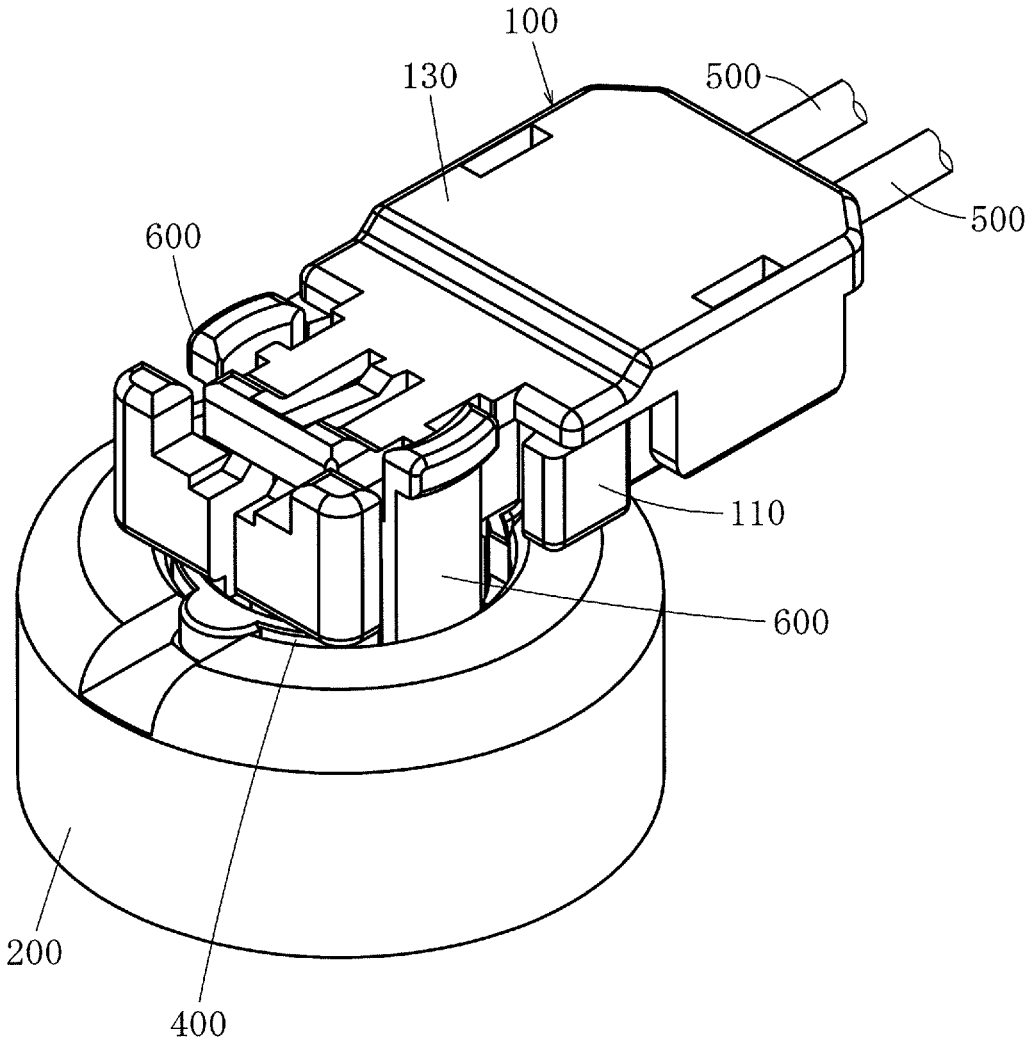
FIG. 17 is a perspective view of the electrical connector, the inflator housing, the squib, and the retainer when the mating portion of the housing has been mated to the retainer. The moving member is at the first position relative to the housing body.
Figure 18:
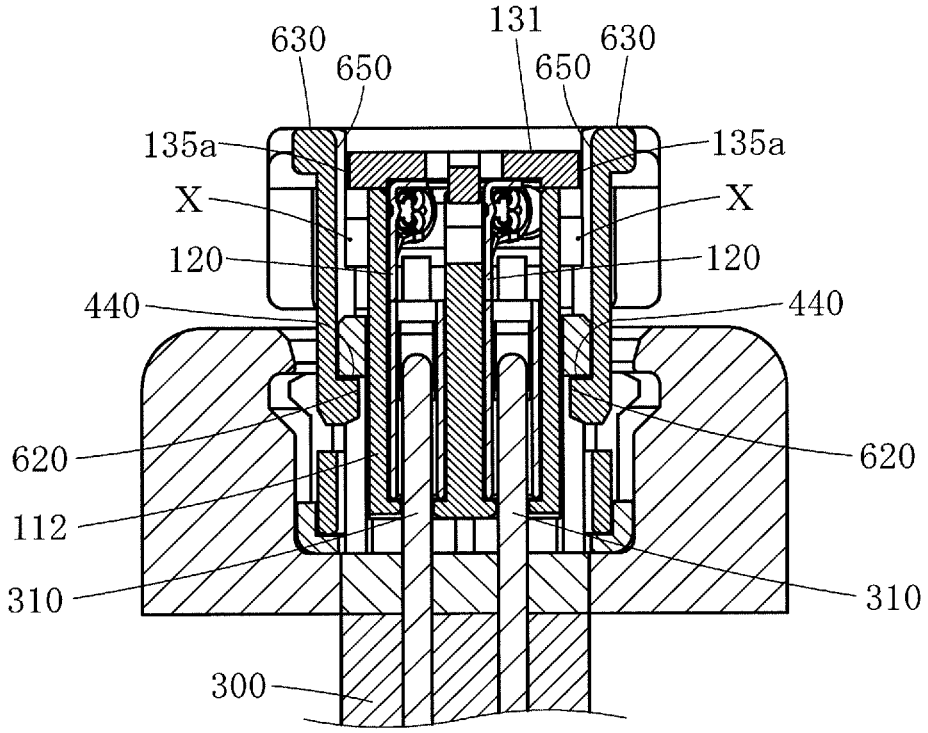
FIG. 18 is a vertical cross-sectional view of the electrical connector, the inflator housing, the squib, and the retainer in the state shown in FIG. 17, the cross-section being taken along a line that passes through the lock arms.
Figure 19:
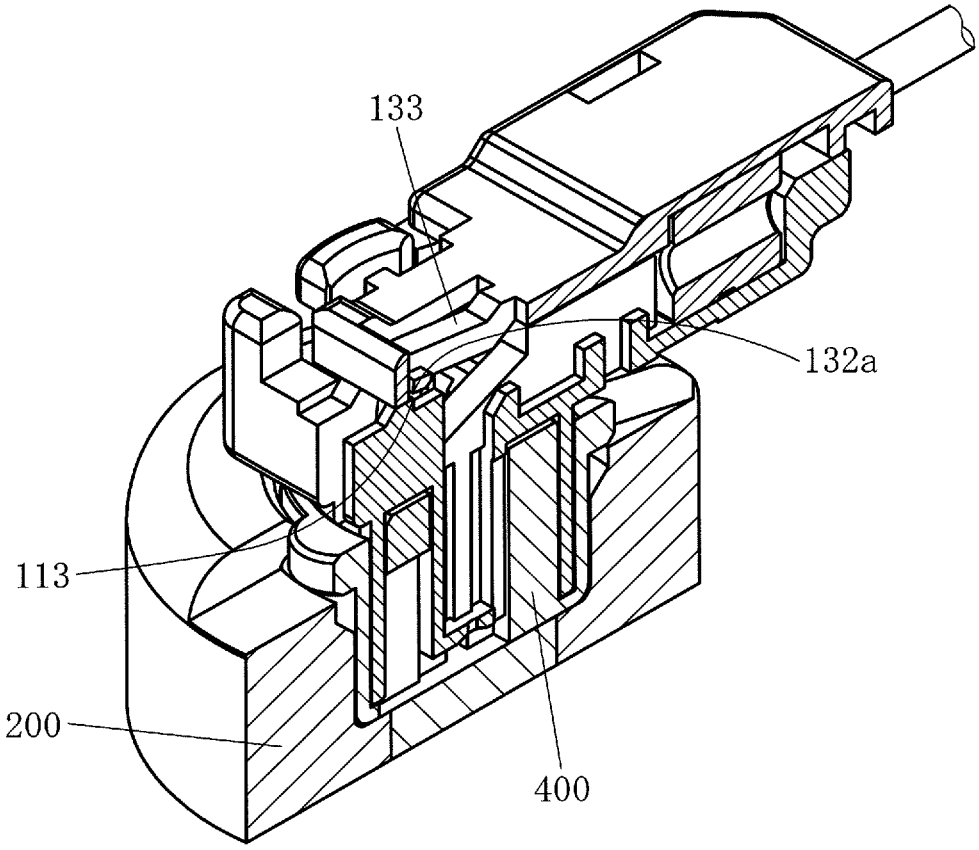
FIG. 19 is a perspective view of the electrical connector, the inflator housing, the squib, and the retainer in the state shown in FIG. 17, the cross-section being taken along a line that passes through a first step portion of the housing.
Figure 20:
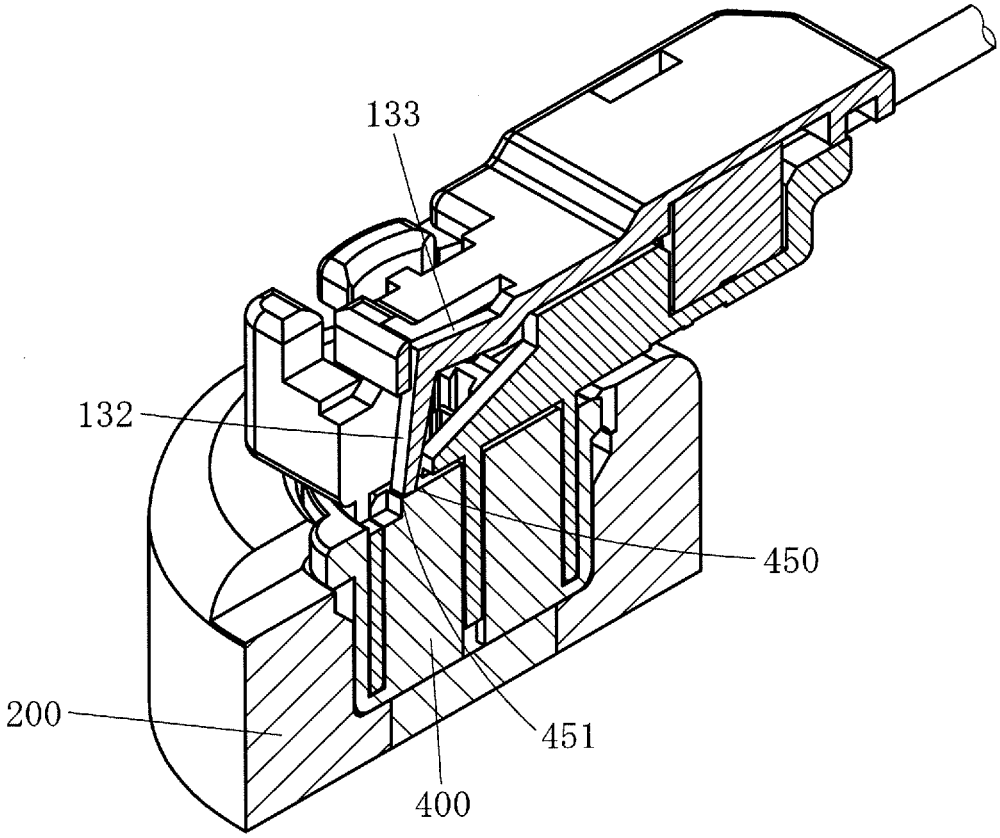
FIG. 20 is a perspective view of the electrical connector, the inflator housing, the squib, and the retainer in the state shown in FIG. 17, the cross-section being taken along a line that passes through the detection portion.
Figure 21:
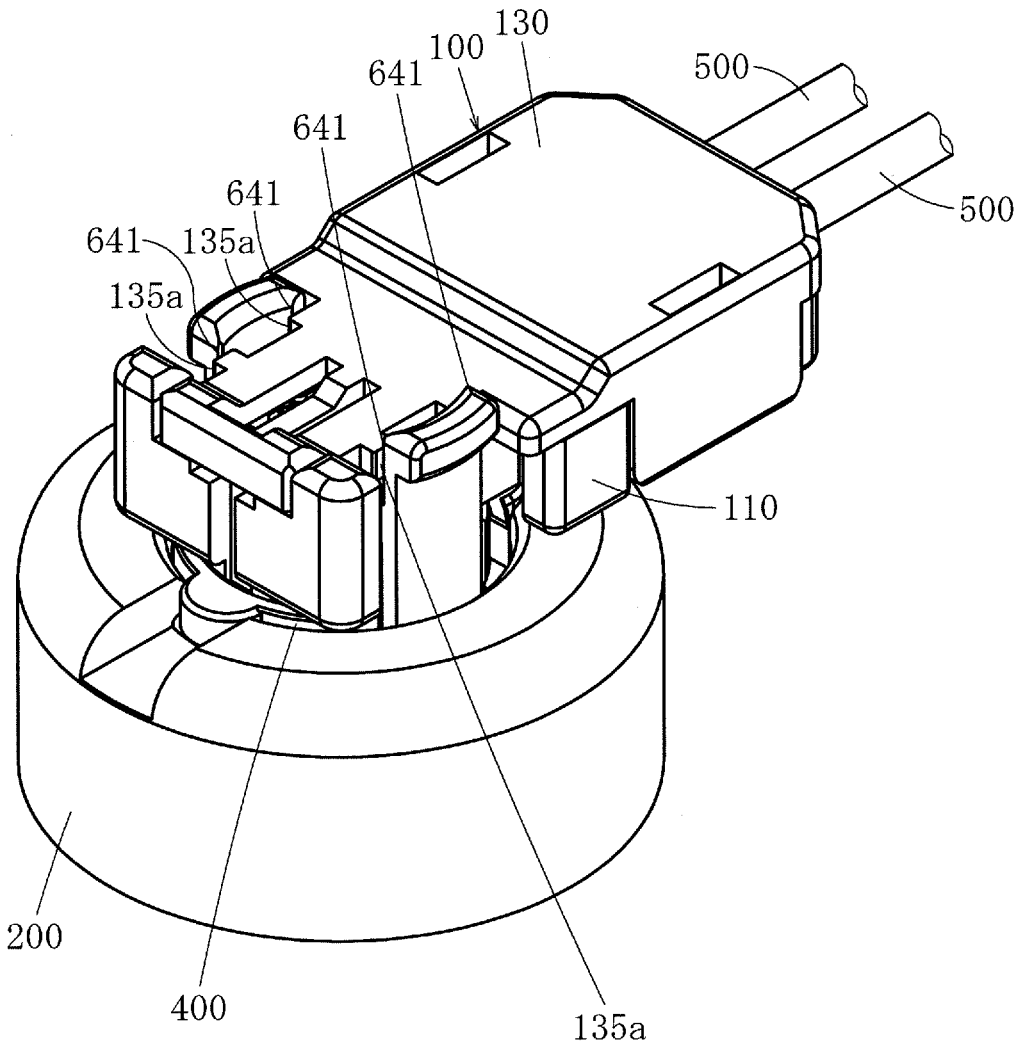
FIG. 21 is a perspective view of the electrical connector in the state shown in FIG. 17, when the moving member has been moved from the first position to the second position relative to the housing body.
Figure 22:
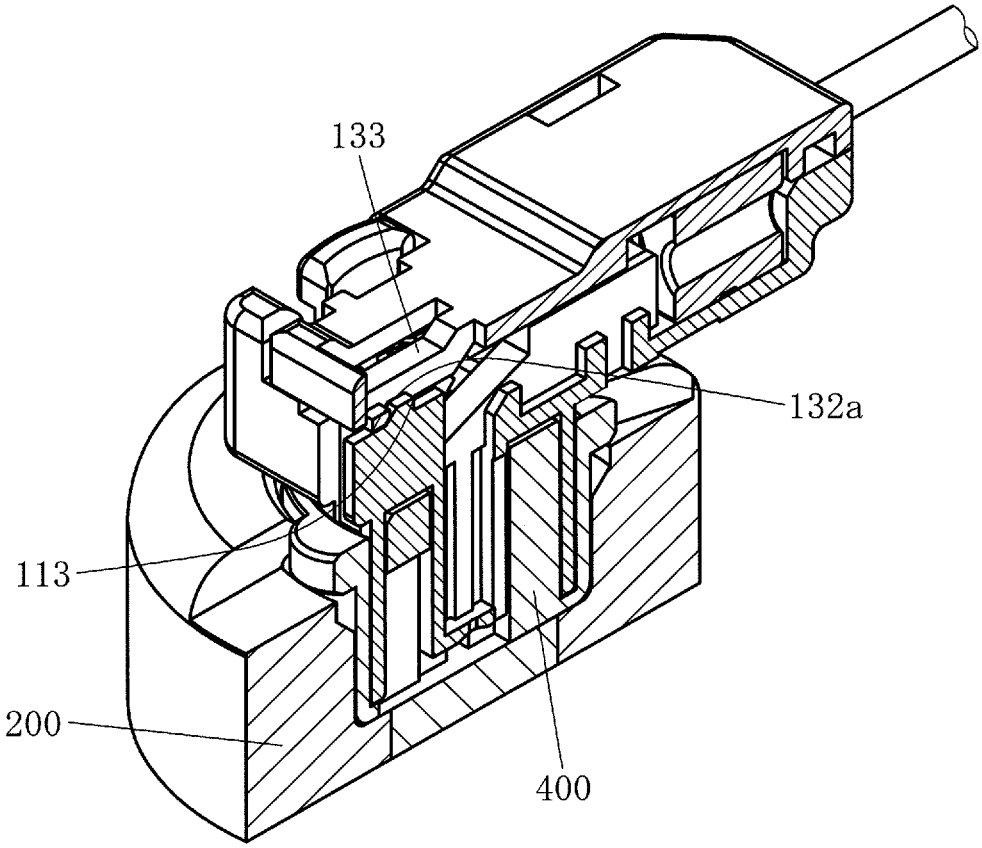
FIG. 22 is a perspective view of the electrical connector, the inflator housing, the squib, and the retainer in the state shown in FIG. 21, the cross-section being taken along a line that passes through a first step portion of the housing.
Figure 23:
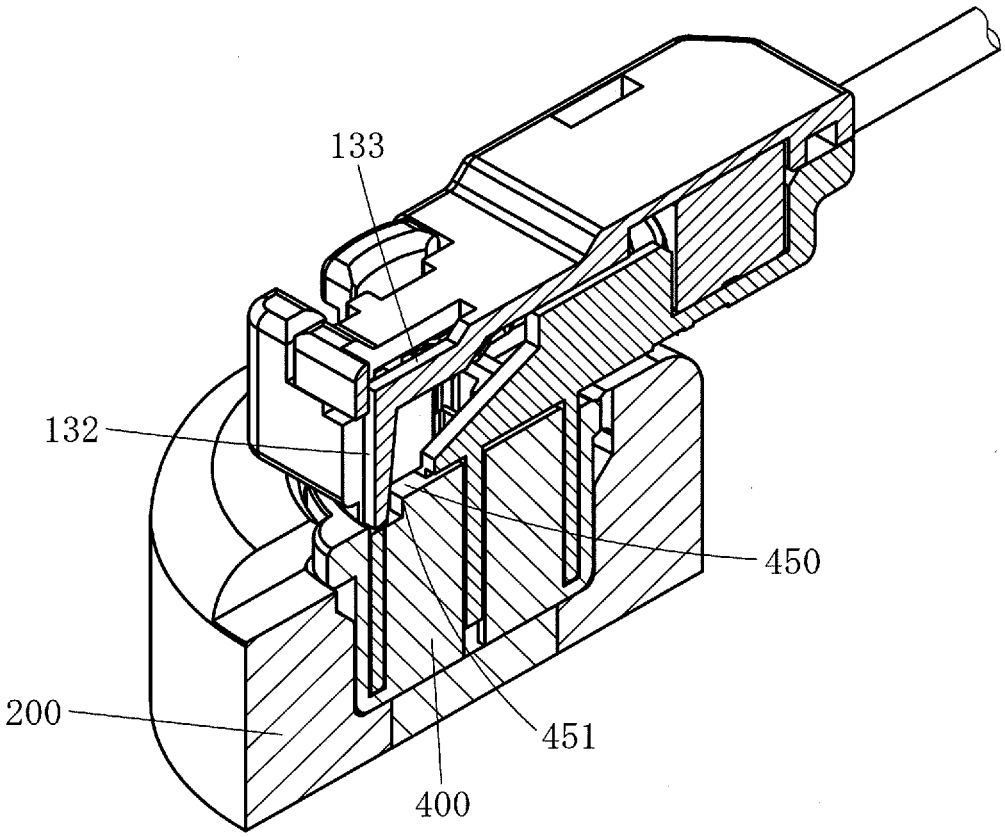
FIG. 23 is a perspective view of the electrical connector, the inflator housing, the squib, and the retainer in the state shown in FIG. 21, the cross-section being taken along a line that passes through the detection portion.

With this configuration, as shown in FIG. 7, when the moving member 130 is at a first position relative to the housing body 111, the second step portions 132*a* come into contact with the first step portions 113 such that the moving member 130 is prevented from moving forward in the movement direction. As shown in FIGS. 10 to 12, even when the mating portion 112 is partially fitted but not completely fitted into the retainer 400, the second step portions 132*a* come into contact with the first step portions 113 such that the moving member 130 is prevented from moving forward in the movement direction, and the moving member 130 is held at the first position relative to the housing body 111. Furthermore, as shown in FIGS. 13 to 16, even when the mating portion 112 is a little more deeply fitted but not completely fitted into the retainer 400, the second step portions 132*a* come into contact with the first step portions 113 such that the moving member 130 is prevented from moving forward in the movement direction, and the moving member 130 is held at the first position relative to the housing body 111. Then, as shown in FIGS. 17 to 20, when the mating portion 112 is completely fitted into the retainer 400. The detection portion 132 comes into contact with the retainer 400, the detection portion 132 then undergoes deformation toward the counter mating side due to being pressed by the retainer 400, and the moving member 130 is permitted to move forward in the movement direction due to the second step portion 132*a* becoming separated from the first step portion 113, thus enabling the moving member 130 to move forward from the first position relative to the housing body 111 to a second position that is in front of the first position in terms of the movement direction. A stop portion 450 that has a face facing the counter mating side is formed on the retainer 400, and the detection portion 132 comes into contact with this stop portion 450, but the stop portion may be provided on another portion of the retainer. In this way, when the second step portion 132*a* is separated from the first step portion 113 and the moving member 130 moves forward from the first position to the second position relative to the housing body 111, the relative positional relationship between the moving member 130 and the housing body 111 changes as shown in FIGS. 21 to 23. FIG. 8 shows the electrical connector 100 at this time. It can be visually understood that the mating portion 112 is completely fitted into the retainer 400 due to the change in the relative positional relationship from FIG. 7 to FIG. 8. This embodiment is configured such that when the mating portion 112 is completely fitted into the retainer 400, the detection portion 132 comes into contact with the retainer 400, but as a variation, a configuration is possible in which when the mating portion 112 is completely fitted into the retainer 400, the detection portion 132 comes into contact with the inflator housing 200. The detection portion 132 then undergoes deformation toward the counter mating side due to being pressed by the inflator housing 200, and the moving member 130 is permitted to move forward in the movement direction due to the second step portion 132*a* becoming separated from the first step portion 113, thus enabling the moving member 130 to move forward from the first position relative to the housing body 111 to the second position that is in front of the first position in terms of the movement direction. In this case, a stop portion that has a face facing the counter mating side, for example, is formed on the inflator housing, and the detection portion comes into contact with this stop portion. This stop face may be provided on the bottom portion of the socket. However, this stop portion may be provided on another portion of the inflator housing. Although the tip of the detection portion 132 on the mating side comes into contact with the retainer 400 or the inflator housing in this embodiment, a configuration is possible in which an intermediate portion, another portion, or the like of the detection portion comes into contact with the retainer or the inflator housing.

In the case of this embodiment, lock arms 600 are provided on the housing 110 as shown in FIG. 1 and the like. Although two lock arms 600 are provided in this embodiment, one lock arm 600 may be provided, or three may be provided, or more may be provided. The lock arms 600 extend along the mating direction and are arranged in the vicinity of the moving member body 131. The lock arms 600 are connected to the housing 110 via elastically deforming connection portions 610 so as to be able to tilt about an axis X that, when viewed in the mating direction, extends along a direction that is parallel to the movement direction and orthogonal to the mating direction. The axis X is a virtual axis. In the case of this embodiment, the lock arms 600 are connected to the housing body 111 via the connection portions 610 so as to be able tilt about the axis X, but the lock arms may be connected to the mating portion via the connection portions so as to be able to tilt about the axis.

Figure 25:
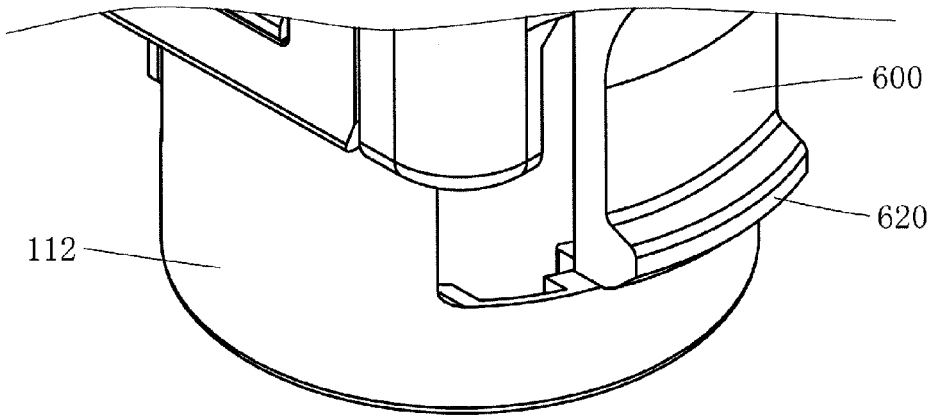
FIG. 25 is an enlarged perspective view of the vicinity of the mating portion of the electrical connector according to another variation of the electrical connector of the present invention.

Projection portions 620 are provided on the lock arms 600 more on the mating side than the connection portions 610 are. The end portions of the lock arms 600 on the counter mating side serve as operation portions 630. The projection portions 620 are provided on the inner side of the lock arms 600. When viewing the lock arms 600 in the mating direction, the inner side of the lock arms 600 is the side that is close to the central portion of the housing body 111, and the outer side is the side opposite to the inner side. With this configuration, as the mating portion 112 is fitted into the retainer 400, the projection portions 620 ride over the structural wall of the retainer 400 and then hook onto recessed portions 440 of the retainer 400, and when the operation portions 630 of the lock arms 600 are pressed so as to tilt the lock arms 600 with the connection portions 610 serving as the fulcrum, the projection portions 620 come out of the recessed portions 440. FIG. 25 shows a variation of the electrical connector 100. In the case of this electrical connector 100, the projection portions 620 are provided on the outer side of the lock arms 600. With this configuration, as the mating portion 112 is fitted into the retainer 400, the projection portions 620 ride over the structural wall 211 of the socket 210 and then hook onto a recessed portion of the socket 210, and when end portions of the lock arms 600 on the counter mating side are pressed so as to tilt the lock arms 600 with the connection portions 610 serving as the fulcrum, the projection portions 620 come out of the recessed portion. The recessed portion of the socket 210 is the above-described groove 212, for example, but may be formed separately. Other aspects of the configuration are similar to the electrical connector of this embodiment.

Among opposing portions of the lock arms 600 and the moving member body 131, that vary in distance from each other depending on the tilt of the lock arms 600, the portions of the lock arms 600 are provided with third step portions 640 that extend rearward in the movement direction and extend toward the sides away from the opposing portions of the moving member body 131 from third end faces 641 that oppose the opposing portions of the moving member body 131. The opposing portions referred to here include not only portions that oppose each other in the width direction, but also portions that oppose each other in a direction that is at an angle to the width direction when viewed in the mating direction. In the case of this embodiment, as shown in FIGS. 3, 6, 7, and the like, the third step portions 640 are provided on the front sides and the rear sides of the operation portions 630 of the lock arms 600 in terms of the movement direction. The third end faces 641 are formed on the front sides and the rear sides of the operation portions 630 in terms of the movement direction. The lock arms 600 are provided with level changes that extend toward the sides away from the aforementioned portions of the moving member body 131 rearward of the third end faces 641 in terms of the movement direction, and rear faces 642 that face rearward in the movement direction and extend toward the sides away from the aforementioned portions of the moving member body 131 are connected to the rear end edges of the third end faces 641 in terms of the movement direction. The third step portions 640 are formed by the level changes extending from the third end faces 641 toward the sides away from the aforementioned portions of the moving member body 131. The third step portions 640 are each shaped as an upside down L when viewed in the mating direction, or the same shape reversed in the left-right direction. The orientation of the rear face may be tilted with respect to the rearward side of the movement direction. The third step portions may be provided on any portions on the lock arms. One third step portion may be provided, or three may be provided, or more may be provided.

Among opposing portions of the lock arms 600 and the moving member body 131 that vary in distance from each other depending on the tilt of the lock arms 600, the portions of the moving member body 131 are provided with fourth step portions 135 that extend forward in the movement direction and extend toward the sides away from the opposing portions of the lock arms 600 from fourth end faces 135*a* that oppose the opposing portions of the lock arms 600. In the case of this embodiment, as shown in FIGS. 3, 6, 7, and the like, support portions 131*a* provided on the front side of the moving member body 131 in terms of the movement direction extend forward in the movement direction inward of the lock arms 600 in terms of the width direction, and the fourth step portions 135 are provided on the front sides and the rear sides of the support portions 131*a* in terms of the movement direction. The fourth end faces 135*a* are formed on the front sides and the rear sides of the support portions 131*a* in terms of the movement direction. The support portions 131*a* are provided with level changes that extend toward the sides away from the aforementioned portions of the lock arms 600 in front of the fourth end faces 135*a* in terms of the movement direction, and front faces 135*b* that face forward in the movement direction and extend toward the sides away from the aforementioned portions of the lock arms 600 are connected to the front end edges of the fourth end faces 135*a* in terms of the movement direction. The fourth step portions 135 are formed by the level changes extending from the fourth end faces 135*a* toward the sides away from the aforementioned portions of the lock arms 600. The fourth step portions 135 are each shaped as an L when viewed in the mating direction, or the same shape reversed in the left-right direction. The front faces may face forward in the movement direction with a tilt. The fourth step portions may be provided on any portions on the moving member body 131. One fourth step portion may be provided, or three may be provided, or more may be provided.

With this configuration, as shown in FIGS. 13 to 16, when the mating portion 112 is fitted into the retainer 400 but not completely fitted therein, the connection portions 610 undergo elastic deformation as the projection portions 620 of the lock arms 600 ride over the structural wall of the retainer 400, and thus the lock arms 600 tilt, the third step portions 640 cut into the path of the fourth step portions 135, and the moving member 130 is prevented from moving forward in the movement direction. In this case, the front faces 135*b* of the fourth step portions 135 come into contact with the rear faces 642 of the third step portions 640, which have moved inward due to the tilting of the lock arms 600, and thus the moving member 130 is prevented from moving forward in the movement direction. With this configuration, next, as shown in FIGS. 17 to 20, when the mating portion 112 is completely fitted into the retainer 400, the projection portions 620 of the lock arms 600 hook onto the recessed portions 440, and the connection portions 610 undergo elastic restoration, and thus the tilting of the lock arms 600 is canceled, the third step portions 640 move out of the path of the fourth step portions 135, and the moving member 130 is permitted to move forward in the movement direction. Accordingly, the moving member 130 can move forward from the first position relative to the housing body 111 to the second position that is in front of the first position in terms of the movement direction.

In the case of this embodiment, as shown in FIGS. 3, 6, 7, and the like, when the moving member 130 reaches the second position relative to the housing body 111, the third end faces 641 and the fourth end faces 135*a* oppose each other in the tilting direction of the lock arms 600, thus preventing tilting of the lock arms 600. In this case, the gap between the third end faces 641 and the fourth end faces 135*a* when they oppose each other in the tilting direction of the lock arms 600 can be set to any distance, but the shorter this gap is, the smaller the permitted tilting angle of the lock arms 600, and the greater the degree of prevention of tilting of the lock arms 600.

Figure 26:
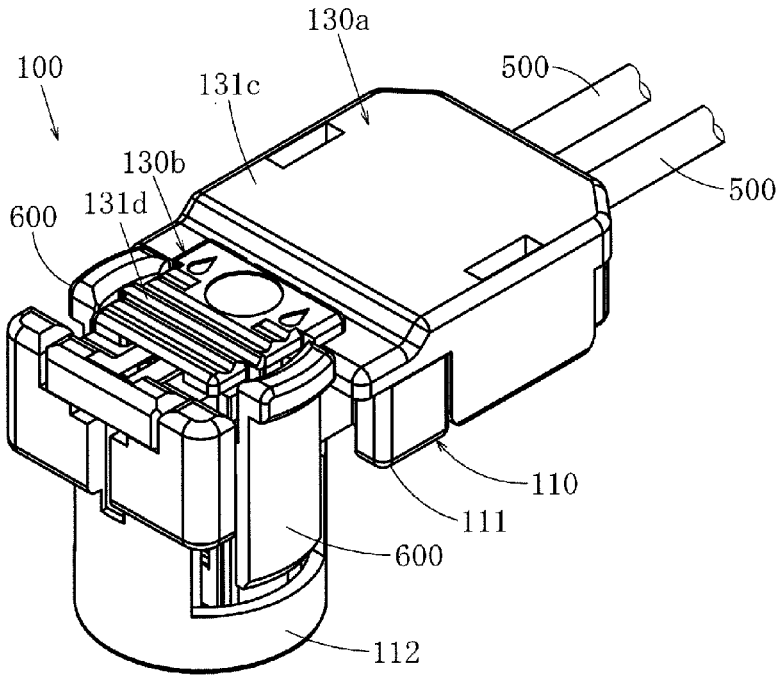
FIG. 26 is a perspective view of an electrical connector according to yet another variation of the electrical connector of the present invention. A first moving member is at a second position relative to the housing body. A second moving member is at a first position relative to the housing body.
Figure 27:
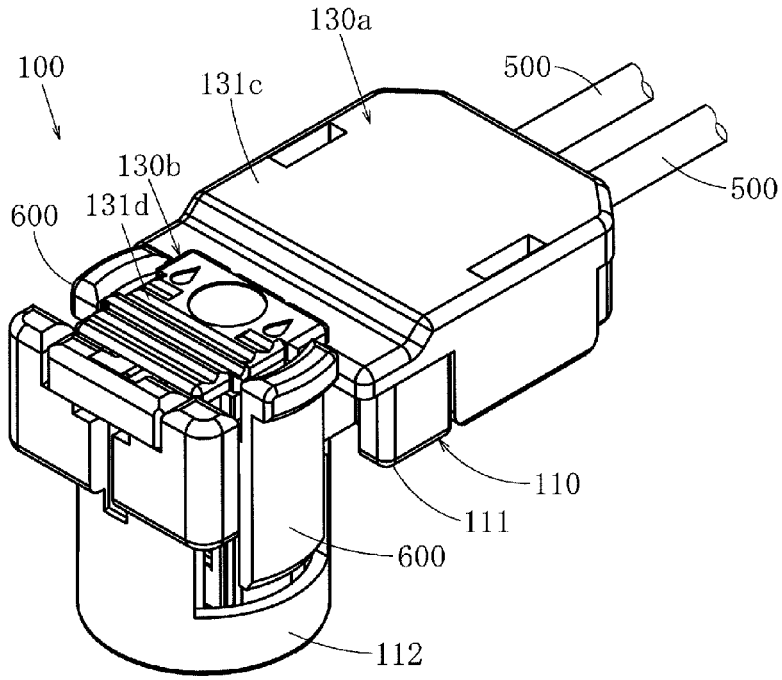
FIG. 27 is a perspective view of the electrical connector according to the aforementioned yet another variation of the electrical connector of the present invention. The first moving member is at the second position relative to the housing body. The second moving member is at the second position relative to the housing body.

In the case of this embodiment, the moving member 130 and the moving member body 131 each undergo one movement as a whole. FIGS. 26 and 27 show variations of the electrical connector 100 that include a moving member and a moving member body that are configured differently from the above-described moving member and moving member body. In the case of this electrical connector 100, the moving member 130 is separated into a first moving member 130*a* and a second moving member 130*b*. Here, the moving member is separated such that the first moving member 130*a* serves as the rear side of the moving member 130 in terms of the movement direction, and the second moving member 130*b* serves as the front side of the moving member 130 in terms of the movement direction. However, the moving member may be separated such that, conversely, the first moving member serves as the front side of the moving member in terms of the movement direction, and the second moving member serves as the rear side of the moving member in terms of the movement direction. The moving member may be separated into a mating side and a counter mating side, the moving member may be separated into an inner side and an outer side in terms of the width direction, or the moving member may be separated into horizontally aligned portions, for example. The first moving member 130*a* includes a first moving member body 131*c* that can move over the housing body 111 along the movement direction, and the detection portion 132 is provided on the first moving member body 131*c*. The second moving member 130*b* includes a second moving member body 131*d* that can move over the housing body 111 along the movement direction, and the fourth step portions 135 are provided on the second moving member body 131*d*. Other aspects of the configuration are similar to the electrical connector of this embodiment. In FIGS. 26 and 27, the first moving member 130*a* is at the second position relative to the housing body 111. The second moving member 130*b* is at the first position relative to the housing body 111 in FIG. 26, and has been moved to the second position in FIG. 27.

In the case of this embodiment, the counter mating side of the housing body 111 is open to the outside, and the moving member body 131 is provided so as to cover the open portion of the housing body 111.

In the case of this embodiment, as shown in FIGS. 3, 6, 7, and the like, fifth step portions 114 are provided in front of the first step portions 113 in terms of the movement direction. Specifically, the housing 110 is provided with fifth step portions 114 that extend forward in the movement direction and extend toward the mating side from the first end faces 113*a*. In the case of this embodiment, two fifth step portions 114 are provided in correspondence with the two first step portions 113. The housing body 111 is provided with a level change that extends toward the mating side in front of each of the first end faces 113*a* in terms of the movement direction, and a front face 114*a* that extends toward the mating side is connected to the front end edge of each of the first end faces 113*a* in terms of the movement direction. The fifth step portions

114 are formed by the level changes extending from the first end faces 113*a* toward the mating side. The front faces 114*a* are formed as tilted faces that gradually extend in the mating direction while moving forward in the movement direction, but the orientation of the front faces is not limited to this, and a configuration is possible in which, for example, the front faces face forward in the movement direction, and the fifth step portions 114 are each shaped as an upside down L when viewed in the width direction, or the same shape reversed in the left-right direction. If the first step portions are provided on the mating portion, the fifth step portions are also provided on the mating portion. The fifth step portions may be provided on any portion along the movement direction, or the width direction on the housing body, or the mating portion. One fifth step portion may be provided, or three may be provided, or more may be provided. In the case of this embodiment, the front faces 114*a* are provided as tilted faces that gradually extend in the mating direction while moving forward in the movement direction, and therefore when the moving member 130 moves rearward from the second position along the movement direction relative to the housing body 111, it can smoothly ride over the first end faces 113*a* and return to the first position. In correspondence with the provision of the fifth step portions 114 on the first step portion 113, the stop portion 450 of the retainer 400 is provided with a sixth step portion 451 that extends toward the mating side while moving forward in the movement direction. According to this, when the moving member 130 moves forward in the movement direction, and the second step portions 132*a* are displaced in the mating direction due to passing the first end faces 113*a* of the first step portions 113, the detection portion 132 becomes displaced in the mating direction due to moving in front of the sixth step portion 451 in terms of the movement direction. Thus, it is possible for the detection portion 132 to return to its natural state, and for a reduction to occur in the load generated by the detection portion 132 being pressed in the counter mating direction. The present invention includes an embodiment of the electrical connector in which the retainer is provided with the fifth step portions, and the sixth step portion is not provided. When the inflator housing is provided with the stop portion, the stop portion may be provided with a sixth step portion that, similarly to the sixth step portion 451, extends toward the mating side while moving forward in the movement direction. However, the present invention includes an embodiment of the electrical connector in which the inflator housing is provided with the fifth step portions, and the sixth step portion is not provided. The electrical connector of the present invention includes an embodiment in which the fifth step portions are not provided.

In the case of the above-described embodiment, recession portions 650 that are recessed away from the moving member body 131 are provided on the lock arms 600 on portions opposing the moving member body 131, and even if the lock arms 600 are tilted when the moving member 130 is at the first position relative to the housing body 111, the fourth end faces 135*a* on the front side are accommodated in the recession portions 650 such that the fourth end faces 135*a* do not come into contact with the lock arms 600, and this permits the lock arms 600 to become tilted due to the projection portions 620 riding over the structural wall 211 of the socket 210 when the mating portion 112 is mated to the retainer 400, and permits the lock arms 600 to become tilted when the operation portions 630 of the lock arms 600 are pressed.

In the case of the above-described variation in which the projection portions 620 of the lock arms are provided on the outer side of the lock arm 600, the support portions 131*a* of the moving member body 131 are provided outward of the operation portions 630 of the lock arms 600, the third step portions 640 are provided outward of the operation portions 630 of the lock arms 600, and the fourth step portions 135 are provided on portions of the support portions 131*a* that oppose the lock arms 600.

Electrical connectors of this type are sometimes provided with a shorting part. Specifically, a shorting part for shorting the squib terminals is provided in order to prevent, for example, malfunction of the squib due to current or the like flowing between the pair of squib terminals before the electrical connector is mated. In this case, for example, when the electrical connector is completely mated to the retainer, the shorting terminal is pushed outward and away due to force received from the electrical connector, thus canceling the shorting. Although this shorting part is not provided in the squib connection device of the above-described embodiment, an embodiment of the squib connection device in which the squib connection device of the above-described embodiment includes the shorting part is included as an embodiment of the squib connection device of the present invention.

Accordingly, in the case of the electrical connector 100 of the above-described embodiment, when the mating portion 112 of the housing 110 is mated to the retainer 400, the contact portions 121 of the electrical terminals 120 are brought into contact with the squib terminals 310, and thus the electrical connector 100 is mechanically and electrically connected to the partner device that includes the inflator housing 200, the squib 300, and the retainer 400. In this case, when the mating portion 112 is not completely fitted into the retainer 400, the detection portion 132 is not pressed by the retainer 400 or the inflator housing 200, and therefore the moving member 130 is at the first position relative to the housing body 111, and the moving member 130 is prevented from moving forward in the movement direction due to the second step portions 132*a* coming into contact with the first step portions 113. Accordingly, when the moving member 130 is at the first position relative to the housing body 111, it is possible to detect that the mating portion 112 is not completely fitted into the retainer 400. On the other hand, when the mating portion 112 is completely fitted into the retainer 400, the detection portion 132 is pressed by the retainer 400 or the inflator housing 200 and becomes displaced toward the counter mating side, and the second step portions 132*a* move away from the first step portions 113 so as to permit the moving member 130 to move forward in the movement direction, and this enables the moving member 130 to move forward from the first position relative to the housing body 111 to the second position that is in front of the first position in terms of the movement direction. Accordingly, when the moving member 130 has moved forward to the second position relative to the housing body 111, it is detected that the mating portion 112 is completely mated to the retainer 400, thus realizing the prevention of incomplete mating.

In this case, the moving member body 131 can move over the housing body 111 along the movement direction, which is at an angle to the mating direction, thus making the mating operation clearly intended to be performed in two steps so as to make it unlikely to forget the operation for moving the moving member 130, and making it unlikely for the moving member 130 to protrude toward the counter mating side of the electrical connector 100. This prevents a problem such as damage to the moving member 130 from occurring. Since the moving member 130 cannot move forward in the movement direction if the mating portion 112 is not completely fitted into the retainer 400, it is possible to, for example, prevent the mating task from needing to be performed again, and prevent damage to the moving member 130, the retainer 400, and the like.

The electrical connector of the present invention includes an embodiment in which the lock arms are not provided. Among the various embodiments, the electrical connector 100 of the above-described embodiment and variations can be configured such that a lock arm 600 that extends along the mating direction is arranged in a vicinity of the moving member body 131 and is connected to the housing 110 via an elastically deforming connection portion 610 so as to be able to tilt about an axis X that, when viewed in the mating direction, extends along a direction that is parallel to the movement direction and orthogonal to the mating direction, a projection portion 620 is provided on the lock arm 600 more on the mating side than the connection portion 610 is, as the mating portion 112 is fitted into the retainer 400, the projection portion 620 rides over a structural wall of the retainer 400 or the socket 210 and hooks onto a recessed portion 440, 212 of the retainer 400 or the socket 210. When an end portion of the lock arm 600 on the counter mating side is pressed so as to tilt the lock arm 600 with the connection portion 610 serving as a fulcrum, the projection portion 620 comes out of the recessed portion 440, 212, among opposing portions of the lock arm 600 and the moving member body 131 that vary in distance from each other depending on the tilt of the lock arm 600, a portion of the lock arm 600 is provided with a third step portion 640 that, while moving rearward in the movement direction, extends toward a side away from the opposing portion of the moving member body 131 from a third end face 641 that opposes the opposing portion of the moving member body 131, the opposing portion of the moving member body 131 is provided with a fourth step portion 135 that, while moving forward in the movement direction, extends toward a side away from the opposing portion of the lock arm 600 from a fourth end face 135*a* that opposes the opposing portion of the lock arm 600. When the projection portion 620 of the lock arm 600 rides over the structural wall 211, the connection portion 610 undergoes elastic deformation, and thus the lock arm 600 tilts, the third step portion 640 cuts into a path of the fourth step portion 135, and the moving member 130 is prevented from moving forward in the movement direction. When the projection portion 620 of the lock arm 600 hooks onto the recessed portion 440, 212, the connection portion 610 undergoes elastic restoration, and thus the tilting of the lock arm 600 is canceled, the third step portion 640 moves out of the path of the fourth step portion 135, and the moving member 130 is permitted to move forward in the movement direction, thus enabling the moving member 130 to move forward from the first position relative to the housing body 111 to the second position that is in front of the first position in terms of the movement direction. According to this configuration, the moving member 130 cannot move forward in the movement direction when the mating portion 112 is not completely fitted into the retainer 400. Accordingly, when the moving member 130 has moved forward to the second position relative to the housing body 111, it is detected that the mating portion 112 is completely mated to the retainer 400, and thus the prevention of incomplete mating is realized by this configuration as well.

The electrical connector of the present invention includes an embodiment in which the function of restricting tilting of the lock arms is not provided. Among the various embodiments, the electrical connector 100 of the above-described embodiment and variations can be configured such that when the moving member 130 reaches the second position relative to the housing body 111, the third end face 641 and the fourth end face 135*a* oppose each other along a tilting direction of the lock arm 600 so as to prevent tilting of the lock arm 600. According to this configuration, even if the lock arms 600 are inadvertently operated while the mating portion 112 is completely mated to the retainer 400, tilting of the lock arms 600 is prevented due to the third end faces 641 and the fourth end faces 135*a* coming face-to-face, thus making it unlikely for the mating portion 112 to come out of the retainer 400, or preventing the same.

The electrical connector of the present invention may be configured such that the moving member and the moving member body each undergo one movement as a whole. Among the various embodiments, the electrical connector 100 of the above-described variations can be configured such that the moving member 130 is separated into a first moving member 130*a* and a second moving member 130*b*. The first moving member 130*a* includes a first moving member body 131*c* that can move over the housing body 111 along the movement direction, and the detection portion 132 is provided on the first moving member body 131*c*. The second moving member 130*b* includes a second moving member body 131*d* that can move over the housing body 111 along the movement direction, and the fourth step portion 135 is provided on the second moving member body 131*d*. According to this configuration, the function for preventing incomplete mating using the detection portion 132 and the function for preventing incomplete mating using the fourth step portions 135 can be obtained separately. Also, in the case of the configuration in which tilting of the lock arms 600 is prevented by the third end faces 641 and the fourth end faces 135*a* opposing each other along the tilting direction of the lock arms 600 when the second moving member 130*b* reaches the second position relative to the housing body 111, a function for making it unlikely for the mating portion 112 to come out of the retainer 400 or preventing the same is obtained separately from the function for preventing incomplete mating using the detection portion 132.

The electrical connector of the present invention may have a configuration in which the counter mating side of the housing body is covered, and the moving member body is provided on the counter mating side. Among the various embodiments, the electrical connector 100 of the above-described embodiment and variations can be configured such that the counter mating side of the housing body 111 is open to the outside, and the moving member body 131 is provided so as to cover the open portion of the housing body 111. According to this configuration, the moving member body 131 functions as a cover for the housing 110, thus eliminating the need to separately provide a cover for the housing 110, thereby making it possible to make the electrical connector 100 commensurately more compact.

A squib connection device of the present invention is also sufficiently disclosed through the above description. Specifically, a squib connection device of the present invention is a squib connection device including: a partner device that has an inflator housing 200 provided with a socket 210 that is recessed toward a counter mating side from a surface on a mating side, a squib 300 provided on the counter mating side of the inflator housing 200 such that a squib terminal 310 rises up toward the mating side from a bottom portion of the socket 210, and a retainer 400 that is attached to the socket 210; and an electrical connector 100 that can be mated to the partner device, wherein the electrical connector 100 includes a housing 110 that has a housing body 111 and a mating portion 112, the mating portion 112 being provided on the mating side of the housing body 111 and capable of being mated to the retainer 400, an electrical terminal 120 that is provided in the housing 110 and has a contact portion 121 that can come into contact with the squib terminal 310, and a moving member 130 that has a moving member body 131 and a detection portion 132, the moving member body 131 being arranged on the counter mating side of the housing body 111 and capable of moving over the housing body 111 along a movement direction that is at an angle to a mating direction, and the detection portion 132 being provided on the moving member body 131 via an elastic portion 133 and capable of being displaced along the mating direction, the housing 110 is provided with a first step portion 113 that extends toward the mating side from a first end face 113*a* on the counter mating side while moving rearward in the movement direction, the detection portion 132 is provided with a second step portion 132*a* that extends toward the counter mating side from a second end face 132*aa* on the mating side while moving forward in the movement direction, and when the moving member 130 is at a first position relative to the housing body 111, the second step portion 132*a* comes into contact with the first step portion 113 so as to prevent the moving member 130 from moving forward in the movement direction, and when the mating portion 112 is completely fitted into the retainer 400, the detection portion 132 becomes displaced toward the counter mating side due to being pressed by the retainer 400 or the inflator housing 200, and the second step portion 132*a* becomes separated from the first step portion 113 so as to permit the moving member 130 to move forward in the movement direction, and thus the moving member 130 can move forward from the first position relative to the housing body 111 to a second position that is in front of the first position in terms of the movement direction.

An overview of embodiments of the present invention will be described below.

1) An electrical connector according to a first aspect of the present invention includes:

a housing that has a housing body and a mating portion, the mating portion being provided on a mating side of the housing body and capable of being mated to a retainer attached to a socket that is recessed toward a counter mating side from a surface of an inflator housing on the mating side;

an electrical terminal that is provided in the housing and has a contact portion that can come into contact with a squib terminal that rises up toward the mating side from a bottom portion of the socket; and a moving member that has a moving member body and a detection portion, the moving member body being arranged on the counter mating side of the housing body and capable of moving over the housing body along a movement direction that is at an angle to a mating direction, and the detection portion being provided on the moving member body via an elastic portion and capable of being displaced along the mating direction, wherein the housing is provided with a first step portion that extends toward the mating side from a first end face on the counter mating side while moving rearward in the movement direction, wherein the detection portion is provided with a second step portion that extends toward the counter mating side from a second end face on the mating side while moving forward in the movement direction, and wherein when the moving member is at a first position relative to the housing body, the second step portion comes into contact with the first step portion so as to prevent the moving member from moving forward in the movement direction, and when the mating portion is completely fitted into the retainer, the detection portion becomes displaced toward the counter mating side due to being pressed by the retainer or the inflator housing, and the second step portion becomes separated from the first step portion so as to permit the moving member to move forward in the movement direction, and thus the moving member can move forward from the first position relative to the housing body to a second position that is in front of the first position in terms of the movement direction.

When the mating portion of the housing is mated to the retainer, and the contact portion of the electrical terminal is brought into contact with the squib terminal, the electrical connector is mechanically and electrically connected to the partner device that has the inflator housing, the squib, and the retainer. In this case, if the mating portion is not completely fitted into the retainer, the detection portion is not pressed by the retainer or the inflator housing, and therefore the moving member is at the first position relative to the housing body, and the second step portion comes into contact with the first step portion, thus preventing the moving member from moving forward in the movement direction. Accordingly, when the moving member is at the first position relative to the housing body, it is possible to detect that the mating portion is not completely fitted into the retainer. On the other hand, when the mating portion is completely fitted into the retainer, the detection portion is pressed by the retainer or the inflator housing and becomes displaced toward the counter mating side, and the second step portion moves away from the first step portion so as to permit the moving member to move forward in the movement direction, and this enables the moving member to move forward from the first position relative to the housing body to the second position that is in front of the first position in terms of the movement direction. Accordingly, when the moving member has moved forward to the second position relative to the housing body, it is detected that the mating portion is completely mated to the retainer, thus realizing the prevention of incomplete mating.

In this case, the moving member body can move over the housing body along the movement direction, which is at an angle to the mating direction, thus making the mating operation clearly intended to be performed in two steps so as to make it unlikely to forget the operation for moving the moving member, and making it unlikely for the moving member to protrude toward the counter mating side of the electrical connector, and this prevents a problem such as damage to the moving member from occurring. Since the moving member cannot move forward in the movement direction if the mating portion is not completely fitted into the retainer, it is possible to, for example, prevent the mating task from needing to be performed again, and prevent damage to the moving member, the retainer, and the like.

The electrical connector according to the first aspect obtains effects of raising the possibility that the mating operation will be clearly intended to be performed in two steps so as to make it unlikely to forget the operation for moving the moving member, and that it will be unlikely for the moving member to protrude toward the counter mating side of the electrical connector so as to prevent a problem such as damage to the moving member from occurring; raising the possibility of preventing, for example, the mating task from needing to be performed again, and the moving member, the retainer, and the like from being damaged; and making it even easier to realize the prevention of incomplete mating.

2) An electrical connector according to a second aspect of the present invention is the electrical connector according to the first aspect, wherein a lock arm that extends along the mating direction is arranged in a vicinity of the moving member body and is connected to the housing via an elastically deforming connection portion so as to be able to tilt about an axis that, when viewed in the mating direction, extends along a direction that is parallel to the movement direction and orthogonal to the mating direction, wherein a projection portion is provided on the lock arm more on the mating side than the connection portion is, as the mating portion is fitted into the retainer, the projection portion rides over a structural wall of the retainer or the socket and hooks onto a recessed portion of the retainer or the socket, and when an end portion of the lock arm on the counter mating side is pressed so as to tilt the lock arm with the connection portion serving as a fulcrum, the projection portion comes out of the recessed portion, wherein among opposing portions of the lock arm and the moving member body that vary in distance from each other depending on the tilt of the lock arm, a portion of the lock arm is provided with a third step portion that, while moving rearward in the movement direction, extends toward a side away from the opposing portion of the moving member body from a third end face that opposes the opposing portion of the moving member body, wherein the opposing portion of the moving member body is provided with a fourth step portion that, while moving forward in the movement direction, extends toward a side away from the opposing portion of the lock arm from a fourth end face that opposes the opposing portion of the lock arm, and wherein when the projection portion of the lock arm rides over the structural wall, the connection portion undergoes elastic deformation, and thus the lock arm tilts, the third step portion cuts into a path of the fourth step portion, and the moving member is prevented from moving forward in the movement direction, and when the projection portion of the lock arm hooks onto the recessed portion, the connection portion undergoes elastic restoration, and thus the tilting of the lock arm is canceled, the third step portion moves out of the path of the fourth step portion, and the moving member is permitted to move forward in the movement direction, thus enabling the moving member to move forward from the first position relative to the housing body to the second position that is in front of the first position in terms of the movement direction.

According to this configuration, the moving member cannot move forward in the movement direction when the mating portion is not completely fitted into the retainer. Accordingly, when the moving member has moved forward to the second position relative to the housing body, it is detected that the mating portion is completely mated to the retainer, and thus the prevention of incomplete mating is realized by this configuration as well.

The electrical connector according to the second aspect obtains the effects obtained by the electrical connector according to the first aspect, and furthermore, due to having a configuration that employs a lock arm, when the moving member has moved forward to the second position relative to the housing body, it is detected that the mating portion is completely mated to the retainer, and thus the prevention of incomplete mating is realized by this configuration as well.

3) An electrical connector according to a third aspect of the present invention is the electrical connector according to the second aspect, wherein when the moving member reaches the second position relative to the housing body, the third end face and the fourth end face oppose each other along a tilting direction of the lock arm so as to prevent tilting of the lock arm.

According to this configuration, even if the lock arm is inadvertently operated while the mating portion is completely mated to the retainer, tilting of the lock arm is prevented due to the third end face and the fourth end face coming face-to-face, thus making it unlikely for the mating portion to come out of the retainer, or preventing the same.

The electrical connector according to the third aspect obtains the effects obtained by the electrical connector according to the second aspect, and furthermore, since tilting of the lock arm is prevented even if the lock arm is inadvertently operated while the mating portion is completely mated to the retainer, it is possible to make it unlikely for the mating portion to come out of the retainer, or prevent the same.

4) An electrical connector according to a fourth aspect of the present invention is the electrical connector according to the second aspect or the electrical connector according to the third embodiment, wherein the moving member is separated into a first moving member and a second moving member, wherein the first moving member includes a first moving member body that can move over the housing body along the movement direction, and the detection portion is provided on the first moving member body, and wherein the second moving member includes a second moving member body that can move over the housing body along the movement direction, and the fourth step portion is provided on the second moving member body.

According to this configuration, the function for preventing incomplete mating using the detection portion and the function for preventing incomplete mating using the fourth step portion can be obtained separately. Also, in the case of the configuration in which tilting of the lock arm is prevented by the third end face and the fourth end face opposing each other along the tilting direction of the lock arm when the second moving member reaches the second position relative to the housing body, a function for making it unlikely for the mating portion to come out of the retainer or preventing the same is obtained separately from the function for preventing incomplete mating using the detection portion.

The electrical connector according to the fourth aspect obtains the effects obtained by the electrical connector according to the second aspect or the electrical connector according to the third aspect, and furthermore, the function for preventing incomplete mating using the detection portion and the function for preventing the mating portion from coming out of the retainer using the protruding portion can be obtained separately.

5) An electrical connector according to a fifth aspect of the present invention is the electrical connector according to any one of the first to fourth aspects, wherein the counter mating side of the housing body is open to the outside, and the moving member body is provided so as to cover the open portion of the housing body.

According to this configuration, the moving member body functions as a cover for the housing, thus eliminating the need to separately provide a cover for the housing, thereby making it possible to make the electrical connector commensurately more compact.

The electrical connector according to the fifth aspect obtains the effects obtained by the electrical connector according to any one of the first to fourth aspects, and furthermore, since the moving member body functions as a cover for the housing, the need to separately provide a cover for the housing is eliminated, thereby making it possible to make the electrical connector commensurately more compact.

6) A squib connection device according to one aspect of the present invention includes: a partner device that has an inflator housing provided with a socket that is recessed toward a counter mating side from a surface on a mating side, a squib provided on the counter mating side of the inflator housing such that a squib terminal rises up toward the mating side from a bottom portion of the socket, and a retainer that is attached to the socket; and an electrical connector that can be mated to the partner device, wherein the electrical connector includes:

a housing that has a housing body and a mating portion, the mating portion being provided on the mating side of the housing body and capable of being mated to the retainer, an electrical terminal that is provided in the housing and has a contact portion that can come into contact with the squib terminal, and a moving member that has a moving member body and a detection portion, the moving member body being arranged on the counter mating side of the housing body and capable of moving over the housing body along a movement direction that is at an angle to a mating direction, and the detection portion being provided on the moving member body via an elastic portion and capable of being displaced along the mating direction, wherein the housing is provided with a first step portion that extends toward the mating side from a first end face on the counter mating side while moving rearward in the movement direction, wherein the detection portion is provided with a second step portion that extends toward the counter mating side from a second end face on the mating side while moving forward in the movement direction, and wherein when the moving member is at a first position relative to the housing body, the second step portion comes into contact with the first step portion so as to prevent the moving member from moving forward in the movement direction, and when the mating portion is completely fitted into the retainer, the detection portion becomes displaced toward the counter mating side due to being pressed by the retainer or the inflator housing, and the second step portion becomes separated from the first step portion so as to permit the moving member to move forward in the movement direction, and thus the moving member can move forward from the first position relative to the housing body to a second position that is in front of the first position in terms of the movement direction.

When the mating portion of the housing is mated to the retainer, and the contact portion of the electrical terminal is brought into contact with the squib terminal, the electrical connector is mechanically and electrically connected to the partner device. In this case, if the mating portion is not completely fitted into the retainer, the detection portion is not pressed by the retainer or the inflator housing, and therefore the moving member is at the first position relative to the housing body, and the second step portion comes into contact with the first step portion, thus preventing the moving member from moving forward in the movement direction. Accordingly, when the moving member is at the first position relative to the housing body, it is possible to detect that the mating portion is not completely fitted into the retainer. On the other hand, when the mating portion is completely fitted into the retainer, the detection portion is pressed by the retainer or the inflator housing and becomes displaced toward the counter mating side, and the second step portion moves away from the first step portion so as to permit the moving member to move forward in the movement direction, and this enables the moving member to move forward from the first position relative to the housing body to the second position that is in front of the first position in terms of the movement direction. Accordingly, when the moving member has moved forward to the second position relative to the housing body, it is detected that the mating portion is completely mated to the retainer, thus realizing the prevention of incomplete mating.

In this case, the moving member body can move over the housing body along the movement direction, which is at an angle to the mating direction, thus making the mating operation clearly intended to be performed in two steps so as to make it unlikely to forget the operation for moving the moving member, and making it unlikely for the moving member to protrude toward the counter mating side of the electrical connector. This prevents a problem such as damage to the moving member from occurring. Since the moving member cannot move forward in the movement direction if the mating portion is not completely fitted into the retainer, it is possible to, for example, prevent the mating task from needing to be performed again, and prevent damage to the moving member, the retainer, and the like.

The squib connection device according to the above aspect obtains effects of raising the possibility that the mating operation will be further clearly intended to be performed in two steps so as to make it unlikely to forget the operation for moving the moving member, and that it will be unlikely for the moving member to protrude toward the counter mating side of the electrical connector so as to prevent a problem such as damage to the moving member from occurring; raising the possibility of preventing, for example, the mating task from needing to be performed again, and the moving member, the retainer, and the like from being damaged; and making it even easier to realize the prevention of incomplete mating.

The electrical connector and the squib connection device of the present invention encompass embodiments that are combinations of features of the above-described embodiment and variations. Furthermore, the above-described embodiment and variations are merely several examples of the electrical connector and the squib connection device of the present invention. Accordingly, the electrical connector and the squib connection device of the present invention are not intended to be limited by the descriptions of the embodiment and variations.

The disclosure of Japanese Patent Application No. 2012-230366 filed on Oct. 17, 2012 including specification, drawings and claims is incorporated herein by reference in its entirety.

The invention claimed is:

1. An electrical connector comprising:

a housing that has a housing body and a mating portion, the mating portion being provided on a mating side of the housing body and capable of being mated to a retainer attached to a socket that is recessed toward a counter mating side from a surface of an inflator housing on the mating side;

an electrical terminal that is provided in the housing and has a contact portion that can come into contact with a squib terminal that rises up toward the mating side from a bottom portion of the socket; and a moving member that has a moving member body and a detection portion, the moving member body being arranged on the counter mating side of the housing body and capable of moving over the housing body along a movement direction that is at an angle to a mating direction, and the detection portion being provided on the moving member body via an elastic portion and capable of being displaced along the mating direction, wherein the housing is provided with a first step portion that extends toward the mating side from a first end face on the counter mating side while moving rearward in the movement direction, wherein the detection portion is provided with a second step portion that extends toward the counter mating side from a second end face on the mating side while moving forward in the movement direction, and wherein when the moving member is at a first position relative to the housing body, the second step portion comes into contact with the first step portion so as to prevent the moving member from moving forward in the movement direction, and when the mating portion is completely fitted into the retainer, the detection portion becomes displaced toward the counter mating side due to being pressed by the retainer or the inflator housing, and the second step portion becomes separated from the first step portion so as to permit the moving member to move forward in the movement direction, and thus the moving member can move forward from the first position relative to the housing body to a second position that is in front of the first position in terms of the movement direction.

2. The electrical connector according to claim 1, wherein a lock arm that extends along the mating direction is arranged in a vicinity of the moving member body and is connected to the housing via an elastically deforming connection portion so as to be able to tilt about an axis that, when viewed in the mating direction, extends along a direction that is parallel to the movement direction and orthogonal to the mating direction, wherein a projection portion is provided on the lock arm more on the mating side than the connection portion is, as the mating portion is fitted into the retainer, the projection portion rides over a structural wall of the retainer or the socket and hooks onto a recessed portion of the retainer or the socket, and when an end portion of the lock arm on the counter mating side is pressed so as to tilt the lock arm with the connection portion serving as a fulcrum, the projection portion comes out of the recessed portion, wherein among opposing portions of the lock arm and the moving member body that vary in distance from each other depending on the tilt of the lock arm, a portion of the lock arm is provided with a third step portion that, while moving rearward in the movement direction, extends toward a side away from the opposing portion of the moving member body from a third end face that opposes the opposing portion of the moving member body, wherein the opposing portion of the moving member body is provided with a fourth step portion that, while moving forward in the movement direction, extends toward a side away from the opposing portion of the lock arm from a fourth end face that opposes the opposing portion of the lock arm, and wherein when the projection portion of the lock arm rides over the structural wall, the connection portion undergoes elastic deformation, and thus the lock arm tilts, the third step portion cuts into a path of the fourth step portion, and the moving member is prevented from moving forward in the movement direction, and when the projection portion of the lock arm hooks onto the recessed portion, the connection portion undergoes elastic restoration, and thus the tilting of the lock arm is canceled, the third step portion moves out of the path of the fourth step portion, and the moving member is permitted to move forward in the movement direction, thus enabling the moving member to move forward from the first position relative to the housing body to the second position that is in front of the first position in terms of the movement direction.

3. The electrical connector according to claim 2, wherein when the moving member reaches the second position relative to the housing body, the third end face and the fourth end face oppose each other along a tilting direction of the lock arm so as to prevent tilting of the lock arm.

4. The electrical connector according to claim 2, wherein the moving member is separated into a first moving member and a second moving member, wherein the first moving member includes a first moving member body that can move over the housing body along the movement direction, and the detection portion is provided on the first moving member body, and wherein the second moving member includes a second moving member body that can move over the housing body along the movement direction, and the fourth step portion is provided on the second moving member body.

5. The electrical connector according to claim 3, wherein the moving member is separated into a first moving member and a second moving member, wherein the first moving member includes a first moving member body that can move over the housing body along the movement direction, and the detection portion is provided on the first moving member body, and wherein the second moving member includes a second moving member body that can move over the housing body along the movement direction, and the fourth step portion is provided on the second moving member body.

6. The electrical connector according to claim 1, wherein the counter mating side of the housing body is open to the outside, and the moving member body is provided so as to cover the open portion of the housing body.

7. The electrical connector according to claim 2, wherein the counter mating side of the housing body is open to the outside, and the moving member body is provided so as to cover the open portion of the housing body.

8. The electrical connector according to claim 3, wherein the counter mating side of the housing body is open to the outside, and the moving member body is provided so as to cover the open portion of the housing body.

9. The electrical connector according to claim 4, wherein the counter mating side of the housing body is open to the outside, and the moving member body is provided so as to cover the open portion of the housing body.

10. The electrical connector according to claim 5, wherein the counter mating side of the housing body is open to the outside, and the moving member body is provided so as to cover the open portion of the housing body.

11. A squib connection device comprising:

a partner device that has an inflator housing provided with a socket that is recessed toward a counter mating side from a surface on a mating side, a squib provided on the counter mating side of the inflator housing such that a squib terminal rises up toward the mating side from a bottom portion of the socket, and a retainer that is attached to the socket; and an electrical connector that can be mated to the partner device, wherein the electrical connector includes:

a housing that has a housing body and a mating portion, the mating portion being provided on the mating side of the housing body and capable of being mated to the retainer, an electrical terminal that is provided in the housing and has a contact portion that can come into contact with the squib terminal, and a moving member that has a moving member body and a detection portion, the moving member body being arranged on the counter mating side of the housing body and capable of moving over the housing body along a movement direction that is at an angle to a mating direction, and the detection portion being provided on the moving member body via an elastic portion and capable of being displaced along the mating direction, wherein the housing is provided with a first step portion that extends toward the mating side from a first end face on the counter mating side while moving rearward in the movement direction, wherein the detection portion is provided with a second step portion that extends toward the counter mating side from a second end face on the mating side while moving forward in the movement direction, and wherein when the moving member is at a first position relative to the housing body, the second step portion comes into contact with the first step portion so as to prevent the moving member from moving forward in the movement direction, and when the mating portion is completely fitted into the retainer, the detection portion becomes displaced toward the counter mating side due to being pressed by the retainer or the inflator housing, and the second step portion becomes separated from the first step portion so as to permit the moving member to move forward in the movement direction, and thus the moving member can move forward from the first position relative to the housing body to a second position that is in front of the first position in terms of the movement direction.

* * * * *